US008525086B2

(12) United States Patent
Imai et al.

(10) Patent No.: US 8,525,086 B2
(45) Date of Patent: Sep. 3, 2013

(54) MICROWAVE HEATING APPLIANCE

(75) Inventors: Hirohisa Imai, Nara (JP); Koji Yoshino, Nara (JP); Masamitsu Kondou, Osaka (JP); Hiroshi Kawai, Nara (JP); Miki Ueda, Nara (JP)

(73) Assignee: Panasonic Corporation, Osaka (JP)

( * ) Notice: Subject to any disclaimer, the term of this patent is extended or adjusted under 35 U.S.C. 154(b) by 1292 days.

(21) Appl. No.: 12/305,314

(22) PCT Filed: Jun. 15, 2007

(86) PCT No.: PCT/JP2007/062169

§ 371 (c)(1),
(2), (4) Date: Dec. 17, 2008

(87) PCT Pub. No.: WO2007/148632

PCT Pub. Date: Dec. 27, 2007

(65) Prior Publication Data

US 2010/0059509 A1 Mar. 11, 2010

(30) Foreign Application Priority Data

Jun. 19, 2006 (JP) ..... 2006-169268

(51) Int. Cl.
*H05B 6/72* (2006.01)
*H05B 6/64* (2006.01)

(52) U.S. Cl.
USPC ..... 219/690; 219/749; 219/751

(58) Field of Classification Search
USPC ..... 219/690, 710, 748, 749, 746, 702, 219/660, 751, 745, 747
See application file for complete search history.

(56) References Cited

U.S. PATENT DOCUMENTS

| | | | | |
|---|---|---|---|---|
| 5,981,928 | A | 11/1999 | Lee | |
| 2001/0002670 | A1 * | 6/2001 | Omori et al. | 219/748 |
| 2002/0162836 | A1 * | 11/2002 | Taino et al. | 219/710 |

FOREIGN PATENT DOCUMENTS

| | | | |
|---|---|---|---|
| GB | 2329565 | A | 3/1999 |
| JP | 09-102390 | A | 4/1997 |
| JP | 09-306664 | A | 11/1997 |
| JP | 2004-071229 | A | 3/2004 |
| JP | 2004-219010 | A | 8/2004 |
| JP | 2004-259646 | A | 9/2004 |
| JP | 3617224 | B2 | 11/2004 |

OTHER PUBLICATIONS

JP09306664A (Translation) High Frequency Heating Device (Matsushita Electric Industrial Co., Ltd) http:/dossier1.ipdl.inpit.go.jp/cgi-bin/tran-web-cgiejje (Date unavailable).*
European Search Report for PCT/JP2007/062169 dated Jul. 22, 2011.
International Search Report for PCT/JP2007/062169; Sep. 3, 2007.

* cited by examiner

*Primary Examiner* — Quang Van
(74) *Attorney, Agent, or Firm* — Pearne & Gordon LLP

(57) ABSTRACT

A microwave heating appliance, capable of achieving a locally concentrated heating in answer to the purpose while achieving a uniform heating in the overall heating chamber in a normal mode, is provided. The microwave heating appliance includes a microwave generating unit, a waveguide for transmitting a microwave from the microwave generating unit, a heating chamber for housing a heated subject heated by the microwave, a rotating antenna for radiating the microwave to the heating chamber, a driving unit for rotating and driving the rotating antenna, a temperature distribution detecting unit for detecting a temperature distribution in the heating chamber, and a controlling unit for controlling a direction of the rotating antenna based on a detected result of the temperature distribution detecting unit so that a sharp part of radiation directivity of the rotating antenna in a direction decided based on the detected result.

17 Claims, 13 Drawing Sheets

MICROWAVE HEATING APPLIANCE

TECHNICAL FIELD

The present invention relates to a microwave heating appliance for dielectrically heating a heated subject.

BACKGROUND ART

The microwave oven as a typical microwave heating appliance can heat directly the foods as a typical heated subject. Therefore, its convenience of needing no cooking pan or pot makes the microwave oven the appliance indispensable to life. Up to now, the microwave oven having a food loading space, width and depth dimensions of which is about 300 to 400 mm respectively and a height dimension of which is about 200 mm, of the heating chamber through which a microwave propagates is widespread commonly.

In recent years, the products having a heating chamber whose food loading space has a flat bottom surface and whose lateral width is widened by setting the width dimension to 400 mm or more relatively larger than the depth dimension such that a plurality of food plates can be heated to enhance its convenience are put to practical use.

By the way, it has been known that a wavelength of the microwave used in the microwave oven is about 120 mm, strong and weak electric field distributions (referred to as "field strength distributions" hereinafter) are caused in the heating chamber, and thus unevenness in heating is caused by a synergistic effect of such unevenness and influences of the shape of the heated subject and its physical property. In particular, in the above heating chamber having the large width dimension, uniformity of the heating must be increased rather than the prior art to heat simultaneously the foods put in plural dishes.

In the prior art, in this type microwave heating appliance, one radiation antenna is provided and is rotated and driven in operation, but it is difficult to heat locally a center area of the heating chamber. Therefore, as the measure of enhancing uniformity in heating, the microwave heating appliance equipped with a plurality of radiation antennas or a plurality of high-frequency stirring unit has been proposed (see Patent Literature 1).

However, the microwave heating appliance does not always heat a large amount of foods, although such heating appliance has a wide heating chamber. For example, when a mug of milk is warmed, it is effective to heat concentratedly the milk only, not heat uniformly the overall heating chamber.

Also, when a plurality of foods are heated at the same time, only the low-temperature food should be heated concentratedly in a situation that a difference resides in temperatures of the foods, for example, the frozen food and the room-temperature food should be heated simultaneously. In addition, like the variety box lunch, or the like, the foods not to be heated (pickles, salad, dessert, etc.) are contained in as one vessel. Therefore, often only the foods to be heated (boiled rice, side dishes, etc.) should be heated concentratedly.

In such case, a function of not heating uniformly the overall heating chamber but heating concentratedly the local area is needed. For this reason, the microwave heating appliance capable of heating concentratedly the heated subject by switching a plurality of antennas and controlling the stop position, and the like has been proposed (see Patent Literature 2).

Patent Literature 1: JP-A-2004-259646
Patent Literature 2: Japanese Patent No. 3617224

DISCLOSURE OF THE INVENTION

Problems that the Invention is to Solve

By reference to Patent Literatures 1, 2, first it seems that, if a plurality of radiation antennas are provided to the right and left sides in the heating chamber having the wide lateral width, uniform heating of the overall heating chamber would be realized. Also, as to the concentrated heating to the local area, the heat can be concentrated to a top end side of the unipole antenna to some extent if the radiation antenna is stopped, for example. However, it is the question to what extent the heat can be concentrated. It is difficult for the actual configuration to realize a locally concentrated heating in response to the purpose while achieving normally a uniform heating in the overall heating chamber.

The present invention has been made to solve the above problems, and it is an object of the present invention to provide a microwave heating appliance capable of achieving a locally concentrated heating in answer to the purpose while achieving a uniform heating in the overall heating chamber in a normal mode.

Means for Solving the Problems

A microwave heating appliance of the present invention, includes a microwave generating unit; a waveguide which transmits a microwave from the microwave generating unit; a heating chamber which houses a heated subject that is heated by the microwave; a rotating antenna which radiates the microwave from the waveguide to the heating chamber; a driving unit which rotates and drives the rotating antenna; a temperature distribution detecting unit which detects a temperature distribution in the heating chamber; and a controlling unit which controls a direction of the rotating antenna by controlling the driving unit based on a detected result of the temperature distribution detecting unit, wherein the controlling unit controls a sharp part of radiation directivity of a plurality of the rotating antennas in a direction decided based on the detected result of the temperature distribution detecting unit to execute a concentrated heating, and wherein the driving unit has a position detecting unit which detects a position of the rotating antenna.

According to this configuration, the adequate localized heating can be realized by directing the sharp part of the radiation directivity of the rotating antenna toward the area in which the heating is needed in the heating chamber, while referring to the detected result of the temperature distribution detecting unit, and also the uniform heating in the heating chamber can be realized by rotating the rotating antenna ordinarily, or the like. Also, the position of the rotating antenna can be detected by the position detecting unit.

Also, a microwave heating appliance of the present invention includes a microwave generating unit; a waveguide which transmits a microwave from the microwave generating unit; a heating chamber which houses a heated subject that is heated by the microwave; a plurality of rotating antennas which radiates the microwave from the waveguide to the heating chamber; a driving unit which rotates and drives the rotating antennas; a temperature distribution detecting unit which detects a temperature distribution in the heating chamber; and a controlling unit which controls directions of the rotating antennas by controlling the driving unit based on a detected result of the temperature distribution detecting unit, wherein the controlling unit controls a sharp part of radiation directivity of at least one of the plurality of rotating antennas in a direction decided based on the detected result of the temperature distribution detecting unit to execute a concentrated heating.

According to this configuration, the adequate localized heating can be realized by directing the sharp part of the radiation directivity of the rotating antenna to the area in which the heating is needed in the heating chamber, while referring to the detected result of the temperature distribution detecting unit, and also the uniform heating in the heating chamber can be realized by rotating the rotating antenna ordinarily, or the like.

Also, in the microwave heating appliance of the present invention, the controlling unit includes an antenna controlling portion having a localized heating mode controlling portion which controls the sharp part of the radiation directivity of the rotating antenna in the direction decided based on the detected result of the temperature distribution detecting unit to execute the concentrated heating, and a distributed heating mode controlling portion for heating uniformly an interior of the heating chamber.

According to this configuration, the interior of the heating chamber can be not only heated concentratedly but also heated uniformly.

Also, in the microwave heating appliance of the present invention, the antenna controlling portion controls the rotating antenna by the distributed heating mode controlling portion in an initial stage of heating start, and controls the rotating antenna by the localized heating mode controlling portion after the initial stage is ended.

According to this configuration, the heated subject can be heated concentratedly after the interior of the heating chamber is heated uniformly.

Also, the microwave heating appliance of the present invention, the antenna controlling portion controls the rotating antenna by the localized heating mode controlling portion in an initial stage of heating start, and controls the rotating antenna by the distributed heating mode controlling portion after the initial stage is ended.

According to this configuration, the interior of the heating chamber can be heated uniformly after the heated subject is heated concentratedly.

Also, in the microwave heating appliance of the present invention, the controlling unit includes a food deciding portion which decides whether or not a heated subject loaded in the heating chamber is a food, and controls the rotating antenna based on a temperature of a food area of the food decided by the food deciding portion.

According to this configuration, when the heated subject is the food, the rotating antenna can be controlled based on the temperature of the food area.

Also, in the microwave heating appliance of the present invention, the controlling unit includes an antenna angle storing portion which stores an angle of the rotating antenna when the sharp part of the radiation directivity of the rotating antenna is directed to a particular area in the heating chamber, and the controlling unit directs the sharp part of the radiation directivity of the rotating antenna toward a low temperature portion of detected areas detected by the temperature distribution detecting unit.

According to this configuration, the low temperature portion can be heated locally with good precision, by storing data collected previously by the experiment in the antenna angle storing portion.

Also, in the microwave heating appliance of the present invention, the distributed heating mode controlling portion executes the distributed heating by changing a stop position of the rotating antenna every moment, rotating continuously the rotating antenna, or changing the stop position of the rotating antenna at random.

According to this configuration, the distributed heating can be executed by changing the stop position of the rotating antenna every moment, rotating continuously the rotating antenna, or changing the stop position of the rotating antenna at random.

Also, in the microwave heating appliance of the present invention, the localized heating mode controlling portion has a reciprocating angle storing portion for storing a reciprocating angle, and the localized heating mode controlling portion makes a reciprocating swinging motion of the rotating antenna around an angle decided by referring to the antenna angle storing portion based on the detected result detected by the temperature distribution detecting unit, by an angle stored in the reciprocating angle storing portion.

According to this configuration, such a situation can be prevented that, because the rotating antenna continues to stop during the radiation of the microwave, the microwave concentrates excessively to a part of the rotating antennas to cause the excessive heating. Even when the rotating antennas are moved by about ±5 degree around the target angle, the localized heating effect to the heated subject is not influenced but an effect enough to prevent the excessive temperature rise of antenna components can be attained.

Also, in the microwave heating appliance of the present invention, the localized heating mode controlling portion has a stop upper limit time storing portion for storing an upper limit time in which the rotating antenna is stopped at a predetermined angle, and a stop time counting portion which counts a time in which the rotating antennas stop, and when a time counted by the stop time counting portion reaches a time stored in the stop upper limit time storing portion, the rotating antenna is moved to a position that is shifted by a predetermined angle.

According to this configuration, such a situation can be prevented that, because the rotating antenna continues to stop during the radiation of the microwave, the microwave concentrates excessively to a part of the rotating antennas to cause the excessive heating. In other words, the condition under which no heated subject is put in the heating chamber gives the most severe condition that is applied to decide experimentally the upper limit time, for the antenna components may be melt down when the microwave is locally concentrated with no load for 30 second to 1 minute. Therefore, a time shorter than the above time, e.g., about 30 second, is set as an upper limit time, and the rotating antenna is rotated just by an angle of 5 degree, for example, when the heating time exceeds this upper limit time.

Also, in the microwave heating appliance of the present invention, the temperature distribution detecting unit includes a plurality of infrared detecting elements, and a driving unit which moves the plurality of infrared detecting elements in a direction that intersects with a direction along which the plurality of infrared detecting elements are aligned.

According to this configuration, a plurality of infrared detecting elements can be moved in the direction that intersects with the direction along which the infrared detecting elements are aligned.

Also, in the microwave heating appliance of the present invention, the driving unit includes a position detecting unit which detects a position of the rotating antenna.

According to this configuration, the position of the rotating antenna can be detected by the position detecting unit.

Also, in the microwave heating appliance of the present invention, the position detecting unit detects an origin of the rotating antenna in an origin detecting mode.

According to this configuration, the origin of the rotating antenna can be detected in the origin detecting mode by the position detecting unit.

Also, in the microwave heating appliance of the present invention, the origin of the rotating antenna is checked before a heating process is executed or after a heating process is executed in the origin detecting mode.

According to this configuration, the origin of the rotating antenna can be confirmed in the origin detecting mode before a heating process is executed or after a heating process is executed.

Also, in the microwave heating appliance of the present invention, the controlling unit stops an operation of a magnetron while the rotating antenna is driven in the origin detecting mode.

According to this configuration, the operation of a magnetron is stopped while the rotating antenna is driven in the origin detecting mode. Thus, generation of the unintended heating state can be prevented.

Also, in the microwave heating appliance of the present invention, the controlling unit contains a menu indicating that, when the origin is not found in the origin detecting mode, an error is decided and the execution of the heating process is inhibited, and a menu indicating that the heating process is executed in a state that the rotating antenna is stopped.

According to this configuration, according to the cooking menu, e.g., when the menu in which it does not matter if deviation of the temperature distribution in the heating chamber occurs, the heating process is executed while the operation of the rotating antenna is stopped. Therefore, the microwave heating appliance can provide the minimum function to the user.

Also, in the microwave heating appliance of the present invention, rotating centers of the plurality of rotating antennas are arranged at a substantially equal distance from a center of the interior of the heating chamber.

According to this configuration, the rotating centers of the rotating antennas are arranged at a substantially equal distance from the center of the heating chamber respectively. Therefore, this configuration enables the sharp radiation directivity part of the rotating antennas, when directed to the center area and its neighborhood, to heat the center area and its neighborhood of the heating chamber, which normally one antenna configuration is hard to heat.

Also, in the microwave heating appliance of the present invention, a a stepping motor is used as the driving unit, and a time difference is provided to timings for inputting a pulse into each stepping motor corresponding to each antenna, in every stepping motor.

According to this configuration, a time difference is provided to timings for inputting a pulse into each stepping motor corresponding to each antenna, in every stepping motor. Therefore, provision of the circuit capable of handling a large current can be neglected, and a size increase of the circuit can be prevented.

Advantages of the Invention

According to the present invention, the microwave heating appliance capable of achieving a locally concentrated heating in response to the purpose while achieving the uniform heating of the overall heating chamber in a normal mode can be provided.

DESCRIPTION OF REFERENCE NUMERALS AND SIGNS

Figure 1:
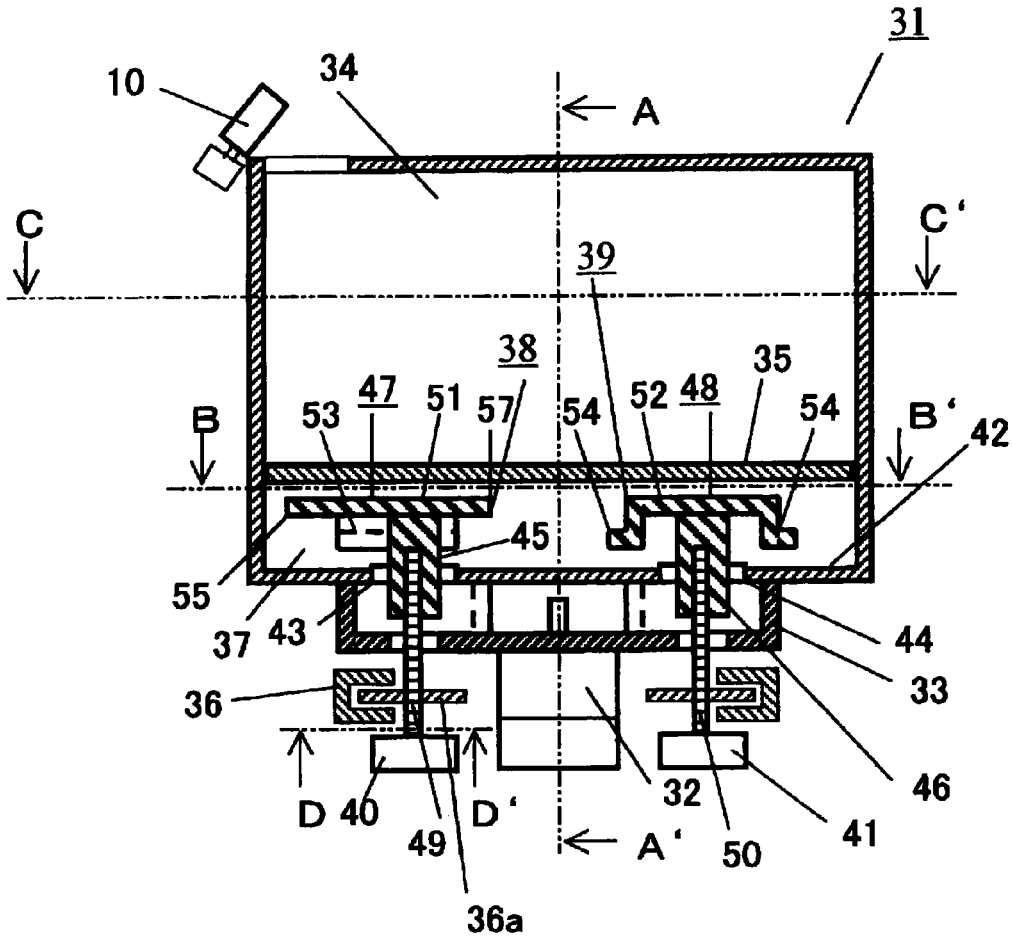
FIG. 1 is a front sectional configurative view of a microwave heating appliance of Embodiment 1 of the present invention.

10 temperature sensor (temperature detecting unit)
31 microwave oven (microwave heating appliance)
32 magnetron (microwave generating unit)
33 waveguide
34 heating chamber
35 loading table
37 antenna space
38, 39 rotating antenna
40, 41 motor (driving unit)
411 controlling unit

BEST MODE FOR CARRYING OUT THE INVENTION

Embodiments according to the present invention will be explained in detail with reference to the drawings hereinafter.

Embodiment 1

Figure 2:
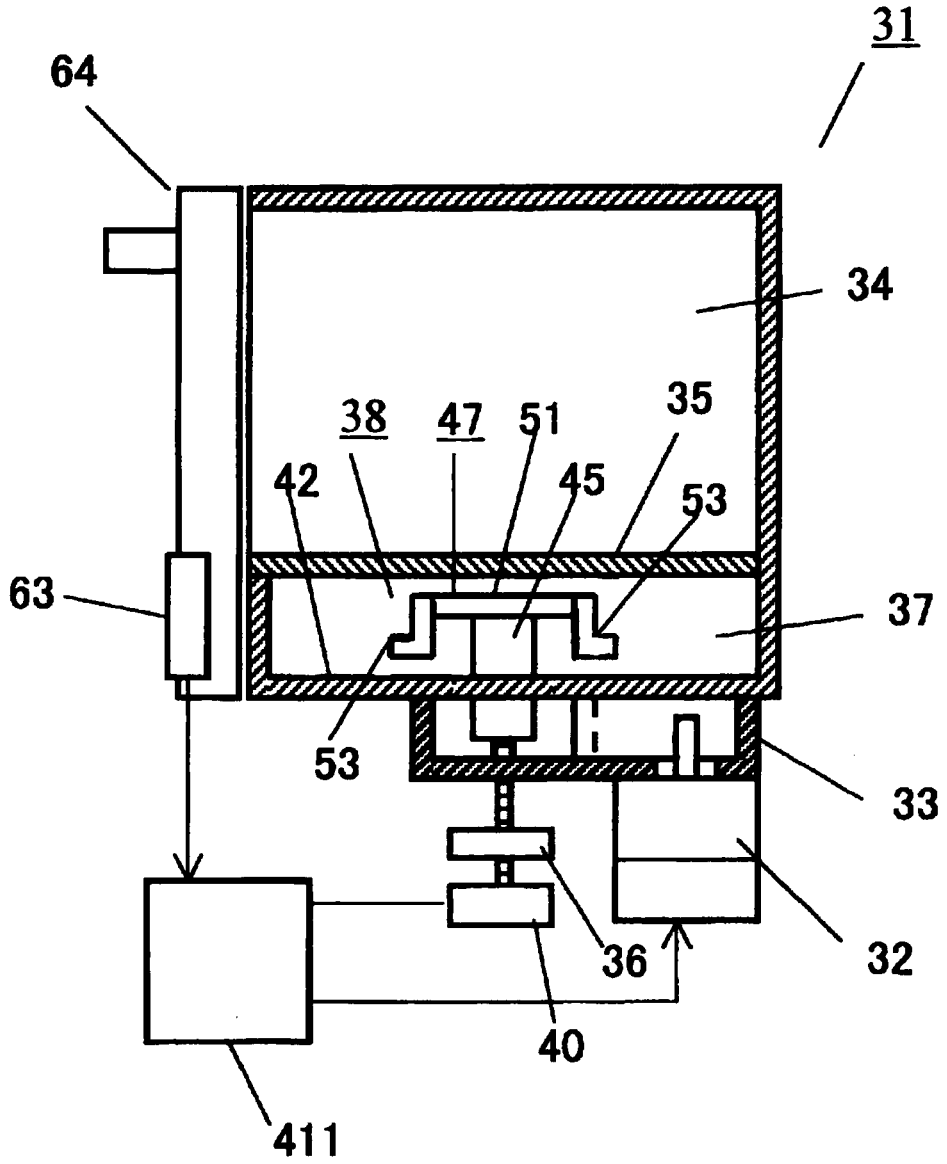
FIG. 2 is a side sectional configurative view of the microwave heating appliance (a sectional view taken along an A-A' line in FIG. 1).
Figure 3:
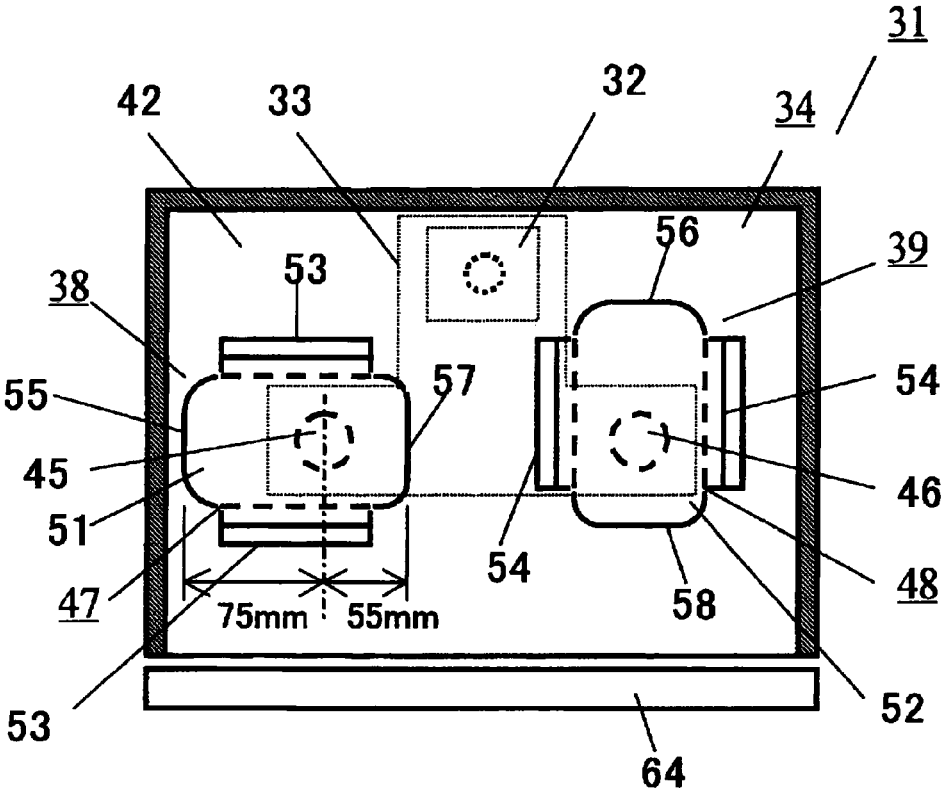
FIG. 3 is a plan sectional configurative view of the microwave heating appliance (a sectional view taken along a B-B' line in FIG. 1).
Figure 4:
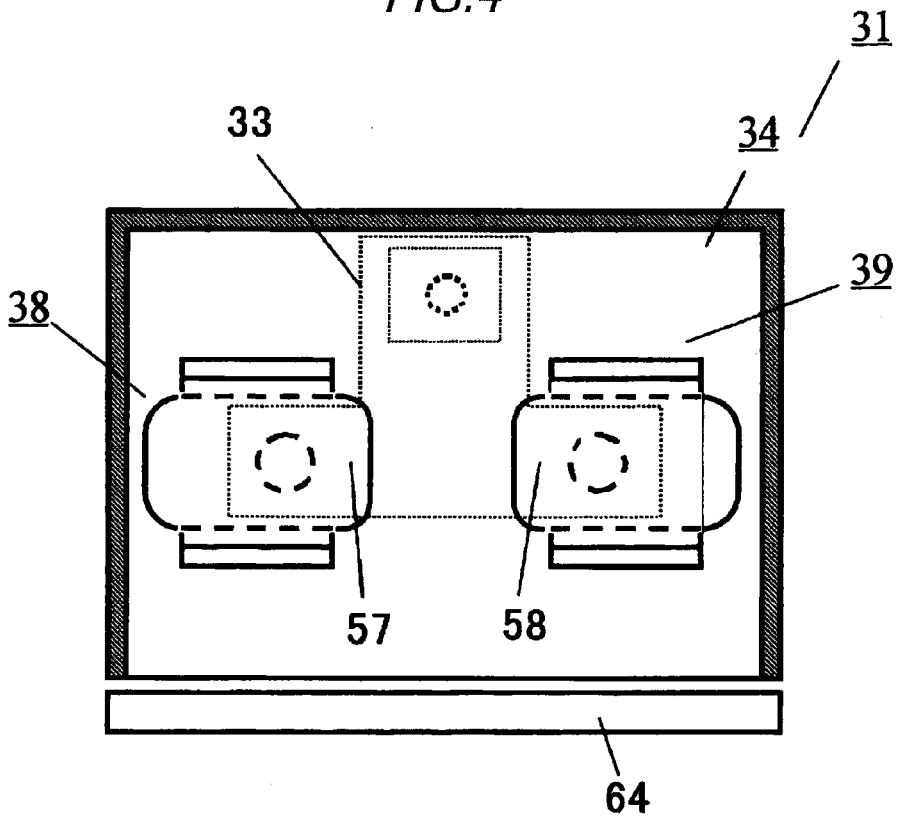
FIG. 4 is a view explaining the direction of a rotating antenna when the center area and its neighborhood in a heating chamber is localizedly heated.

FIG. 1 to FIG. 3 are configurative views of a microwave oven 31 as a typical microwave heating appliance of according to the present invention. FIG. 1 is a sectional view of the microwave oven when viewed from a front side, FIG. 2 is a sectional view of the same taken along an A-A' line in FIG. 1, FIG. 3 is a sectional view of the same taken along a B-B' line in FIG. 1, FIG. 4 is a sectional view of the same taken along a C-C' line in FIG. 1.

As shown in FIG. 1, a microwave oven 31 is equipped with a waveguide 33 for transmitting a microwave radiated from a magnetron 32 as the typical microwave generating unit, a heating chamber 34 connected to an upper portion of the waveguide 33 and having a shape whose dimension in the width direction (about 410 mm) is larger than a dimension in the depth direction (about 315 mm), a loading table 35 fixed in the heating chamber 34 to load a food (not shown) as the typical heated subject thereon and formed of a low loss dielectric material such as ceramic, glass, or the like such that the microwave easily passes through there, an antenna space 37 formed in the heating chamber 34 under the loading table 35, two rotating antennas 38, 39 fitted in the waveguide 33 to the antenna space 37 in symmetrical positions with respect to the width direction of the heating chamber 34 to radiate the microwave from the waveguide 33 to an interior of the heating chamber 34, motors 40, 41 as typical driving unit for rotating/driving the rotating antennas 38, 39, a controlling unit 411 for controlling the direction of the rotating antennas 38, 39 by controlling the motors 40, 41, photo interrupters 36 constituting an origin detecting mechanism for detecting an origin of the rotating antennas 38, 39 respectively, and an infrared sensor 10 as a temperature distribution detecting unit for detecting a temperature distribution in the heating chamber 34.

Also, as shown in FIG. 2, the microwave oven 31 has a door 64. Also, a setting unit 63 is provided to the lower portion of the door 64. The user can choose various cooking menus in accordance with the food or the cooking process by using the setting unit 63. The controlling unit 411 controls the magnetron 32 and the motors 40, 41 based on this chosen result.

The rotating antennas 38, 39 have the radiation directivity respectively. The microwave oven 31 of Embodiment 1 is constructed such that the sharp radiation directivity part of at least one of the rotating antennas 38, 39 is controlled in a predetermined direction to heat concentratedly the particular food. It will be explained later how this microwave oven 31 should be controlled concretely.

Also, the rotating antennas 38, 39 have coupling portions 45, 46 provided to the boundary between the waveguide 33 and the heating chamber bottom surface 42, and radiating portions 47, 48 connected electrically integrally to upper ends of the coupling portions 45, 46 by the caulking, the welding, or the like. The coupling portions 45, 46 are formed of an almost cylindrical conductive material of about 18 mm diameter to pass through almost circular coupling holes 43, 44 of about 30 mm diameter. The radiating portions 47, 48 are formed of the conductive material that is wider generally in the horizontal direction rather than the vertical direction.

Also, the rotating antennas 38, 39 are fitted on shafts 49, 50 of the motors 40, 41 such that centers of the coupling holes 43, 44 coincide with centers of the rotating/driving operations. The radiating portions 47, 48 have an uneven profile in the rotating direction to have their radiation directivity respectively.

The rotating centers of the rotating antennas 38, 39 are arranged at an almost equal distance from a center of the heating chamber 34 respectively. This configuration enables the sharp radiation directivity part of the rotating antennas 38, 39, when directed to the center area and its neighborhood, to heat the center area and its neighborhood of the heating chamber 34, in which normally one antenna configuration is hard to heat.

As shown in FIG. 3, the waveguide 33 is constructed like a T-shape and has a bilaterally symmetrical shape when viewed from the top. Therefore, respective distances from the magnetron 32 to the coupling portions 45, 46 are equal and the coupling portions 45, 46 are fitted to symmetrical positions in the width direction of the heating chamber 34. As a result, the microwave radiated from the magnetron 32 is distributed substantially uniformly in the heating chamber 34 via the waveguide 33 and the rotating antennas 38, 39.

The radiating portions 47, 48 have the same shape such that radiating portion upper surfaces 51, 52 are shaped into an almost quadrangle whose four corners are rounded respectively. Radiating portion bent portions 53, 54 that are bent to the heating chamber bottom surface 42 side are provided to two opposing sides respectively to restrict the radiation of the microwave toward the outsides of two sides. Respective distances from the heating chamber bottom surface 42 to the radiating portion upper surfaces 51, 52 are set to about 10 mm, and the radiating portion bent portions 53, 54 are pulled down to the positions that are set lower than the radiating portion upper surfaces 51, 52 by about 5 mm respectively.

Also, remaining two sides have different lengths from the coupling portions 45, 46 to their end portions in the horizontal direction, and constitute end portions 55, 56 whose length from the center of the coupling portion is about 75 mm respectively and end portions 57, 58 whose length from the center of the coupling portion is about 55 mm respectively. Also, both dimensions of the end portions in the width direction are set to 80 mm or more. According to this configuration, the rotating antennas 38, 39 can enhance the radiation directivity in the direction from the coupling portions 45, 46 to the end portions 57, 58.

In this configuration, when the ordinary food is heated uniformly, the location of such food is not particularly considered like the known microwave oven, and also the rotating antennas 38, 39 may be rotated uniformly like the known art. In contrast, in the case of the concentrated heating, when the center area and its neighborhood in the heating chamber 34 is to be heated, the controlling unit 411 controls the rotating antennas 38, 39 such that, as shown in FIG. 4, their end portions 57, 58 are directed in a predetermined direction that aims at an almost center of the heating chamber 34 in the width direction and an almost center in the depth direction.

When the end portions 57, 58 of the rotating antennas 38, 39 are directed to the almost center of the heating chamber 34 in the width direction and the almost center in the depth direction, the radiation directivity toward the end portions 57, 58 becomes sharp. Therefore, the microwave is radiated particularly from the direction of the end portions 57, 58 and thus the food positioned in that direction can be heated concentratedly.

Figure 5:
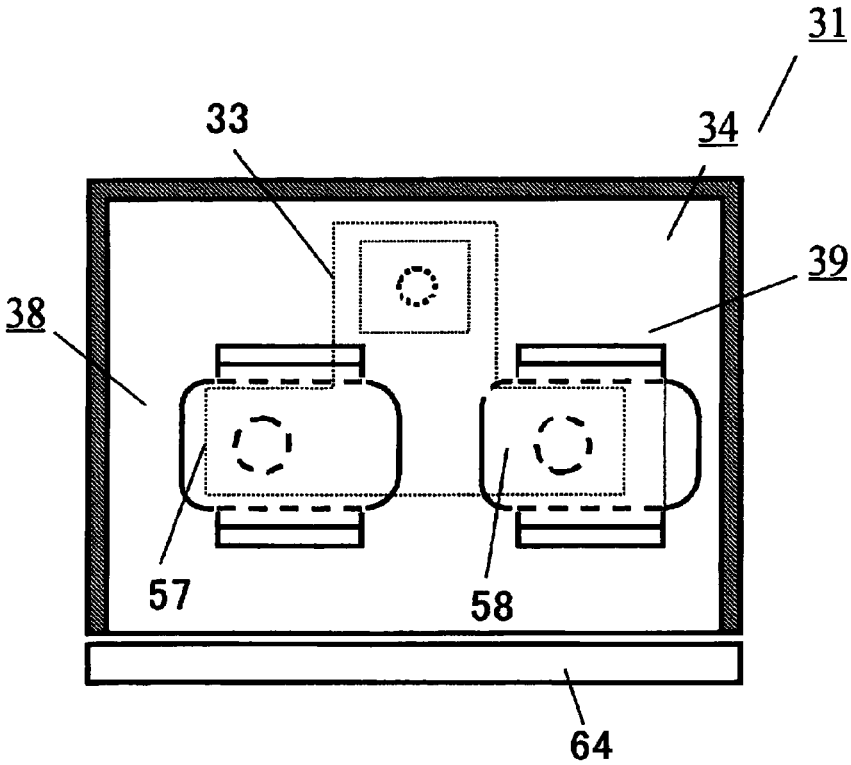
FIG. 5 is a view explaining the direction of a rotating antenna when the left side in a heating chamber is localizedly heated.

Also, when the left-side area in the heating chamber 34 is to be heated, the controlling unit 411 controls the rotating antennas 38, 39 such that, as shown in FIG. 5, their end portions 57, 58 are directed leftward (the left side when the heating chamber 34 is viewed from the door 64 side).

When both end portions 57, 58 of the rotating antennas 38, 39 are directed leftward when the heating chamber 34 is viewed from the door 64 side, the radiation directivity of respective antennas toward the end portions 57, 58 becomes sharp. Therefore, the microwave is radiated particularly from the direction of the end portions 57, 58 and thus the food positioned in that direction can be heated concentratedly.

Figure 6:
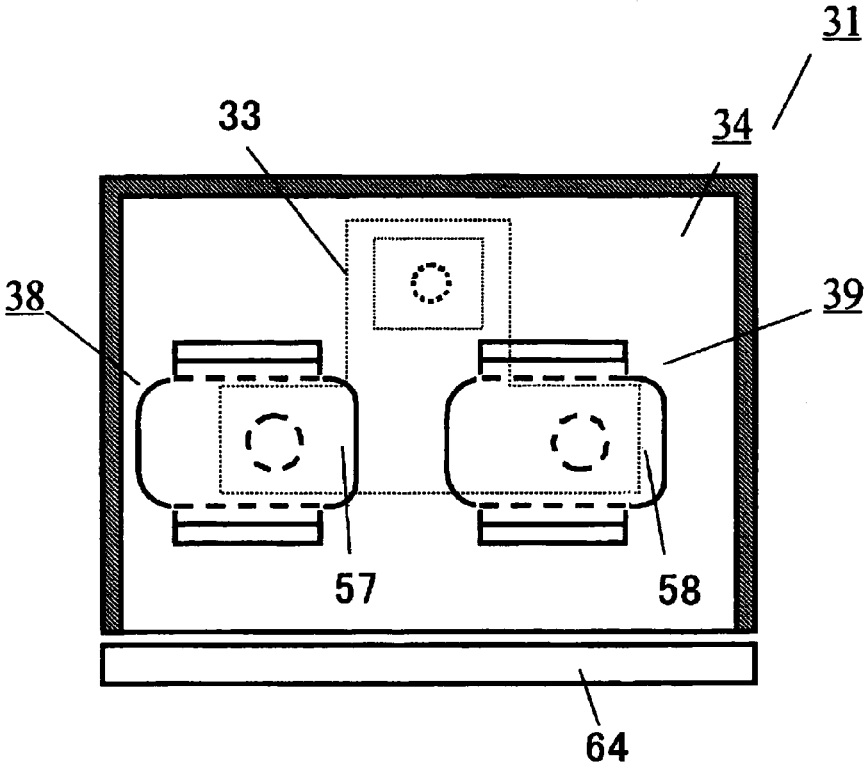
FIG. 6 is a view explaining the direction of a rotating antenna when the right side in a heating chamber is localizedly heated.

Similarly, when the right-side area in the heating chamber 34 is to be heated, the controlling unit 411 controls the rotating antennas 38, 39 such that, as shown in FIG. 6, their end portions 57, 58 are directed rightward (the right side when the heating chamber 34 is viewed from the door 64 side).

When both end portions 57, 58 of the rotating antennas 38, 39 are directed rightward when the heating chamber 34 is viewed from the door 64 side, the radiation directivity of respective antennas toward the end portions 57, 58 becomes sharp. Therefore, the microwave is radiated particularly from the direction of the end portions 57, 58 and thus the food positioned in that direction can be heated concentratedly.

Figure 7:
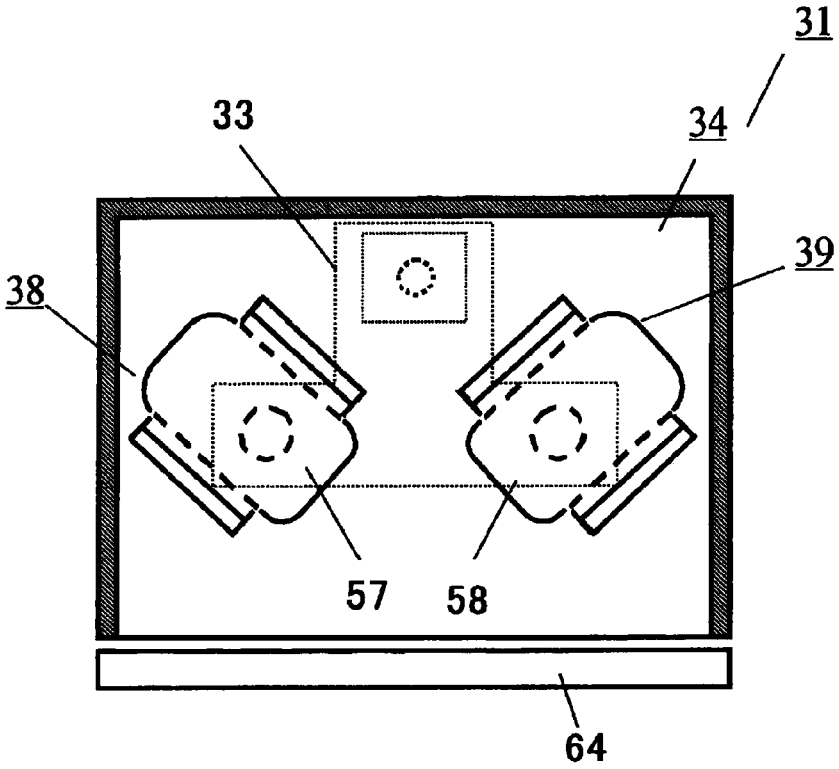
FIG. 7 is a view explaining the direction of a rotating antenna when the front side in a heating chamber is localizedly heated.

Also, when the front center area and its neighborhood in the heating chamber 34 is to be heated, the controlling unit 411 controls the rotating antennas 38, 39 such that, as shown in FIG. 7, their end portions 57, 58 are directed to aim at an almost center of the heating chamber 34 in the width direction and an almost front area in the depth direction (the front center area and its neighborhood in the heating chamber 34).

As shown in FIG. 7, when the end portions 57, 58 of the rotating antennas 38, 39 are directed to the front center area and its neighborhood in the heating chamber 34, the radiation directivity of respective antennas toward the end portions 57, 58 becomes sharp. Therefore, the microwave is radiated particularly from the direction of the end portions 57, 58 and thus the food positioned in that direction can be heated concentratedly.

Figure 8:
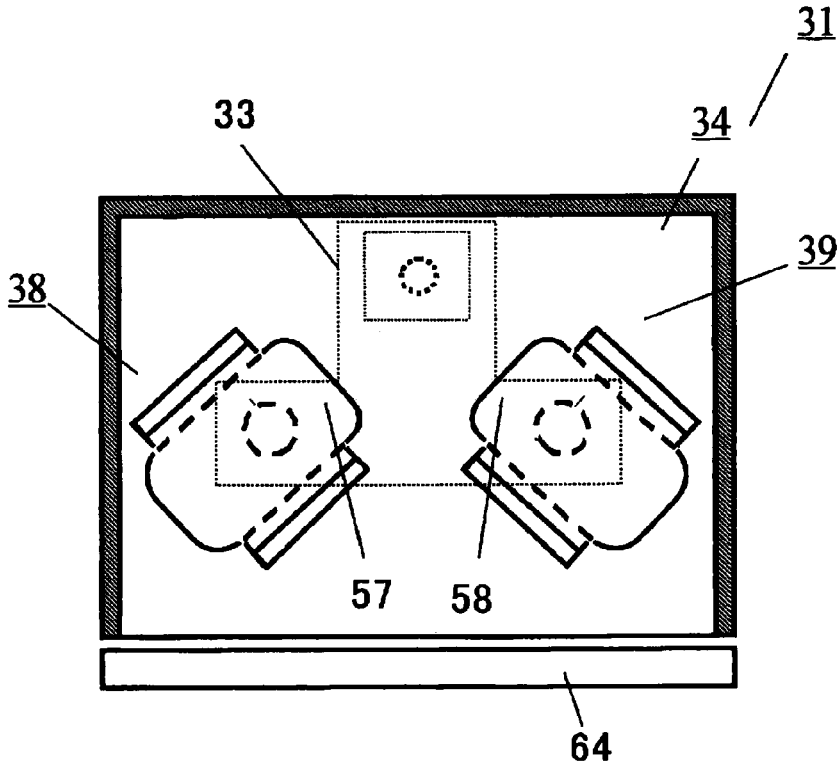
FIG. 8 is a view explaining the direction of a rotating antenna when the rear side in a heating chamber is localizedly heated.

Also, when the rear center area and its neighborhood in the heating chamber 34 is to be heated, the controlling unit 411 controls the rotating antennas 38, 39 such that, as shown in FIG. 8, their end portions 57, 58 are directed to aim at an almost center of the heating chamber 34 in the width direction and an almost rear area in the depth direction (the rear center area and its neighborhood in the heating chamber 34).

As shown in FIG. 8, when the end portions 57, 58 of the rotating antennas 38, 39 are directed to the rear center area and its neighborhood in the heating chamber 34, the radiation directivity of respective antennas toward the end portions 57, 58 becomes sharp. Therefore, the microwave is radiated particularly from the direction of the end portions 57, 58 and thus the food positioned in that direction can be heated concentratedly.

As described above, the microwave oven 31 of Embodiment 1 controls the direction of the rotating antennas in response to the area that is to be localizedly heated. In order to direct the rotating antennas 38, 39 in a predetermined direction, various unit may be considered, for example, a stepping motor is employed as the motors 40, 41, a power feed time of a certain motor is controlled by detecting a reference position, and the like.

Figure 9:
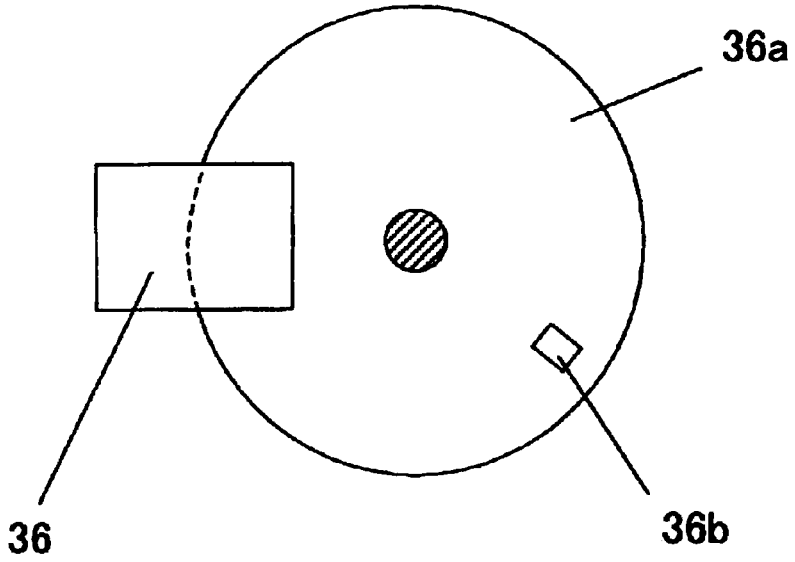
FIG. 9 is a view explaining an origin detecting mechanism of the rotating antenna (a sectional view taken along a D-D' line in FIG. 1).

In the microwave oven 31 of Embodiment 1, a stepping motor is employed as the motors 40, 41, and a position detecting unit for detecting the antenna position is provided to shafts of the motors 40, 41 respectively. This antenna position detecting unit can be constructed by a rotary encoder, a potentiometer, or the like, for example, which is well known to detect a rotating position of the rotation shaft. In the present embodiment, the antenna position detecting unit is constructed by an origin detecting mechanism described later. That is, as shown in FIG. 9, the origin detecting mechanism is composed of a circular plate 36*a* having the shaft as a center shaft and the photo interrupter 36. A rectangular slit 36*b* is provided to the circular plate 36*a*.

The circular plate 36*a* is fitted commonly to the shafts 49, 50 of the motors to rotate the rotating antennas 38, 39 respectively. The circular plate 36*a* rotates to block a light path of the photo interrupter 36 consisting of a light emitting element and a light receiving element.

According to this configuration, the light path is not blocked when the slit 36*b* passes through the light path of the photo interrupter 36, this mechanism can detect a point of time when the slit passes. For this reason, when a position of the slit 36*b* is set to the origins of the rotating antennas 38, 39, the photo interrupter 36 fitted to respective motors can detect the origins of the rotating antennas.

Also, the controlling unit 411 has an antenna angle storing portion that stores previously angles (stop positions) of the rotating antennas 38, 39 on the basis of the origin that the origin detecting mechanism can detect when the sharp radiation directivity part of the rotating antennas 38, 39 are concentrated to the localized heating area. When the localized heating is executed by controlling the operations of the rotating antennas 38, 39, information in this antenna angle storing portion is referred to.

Figure 10:
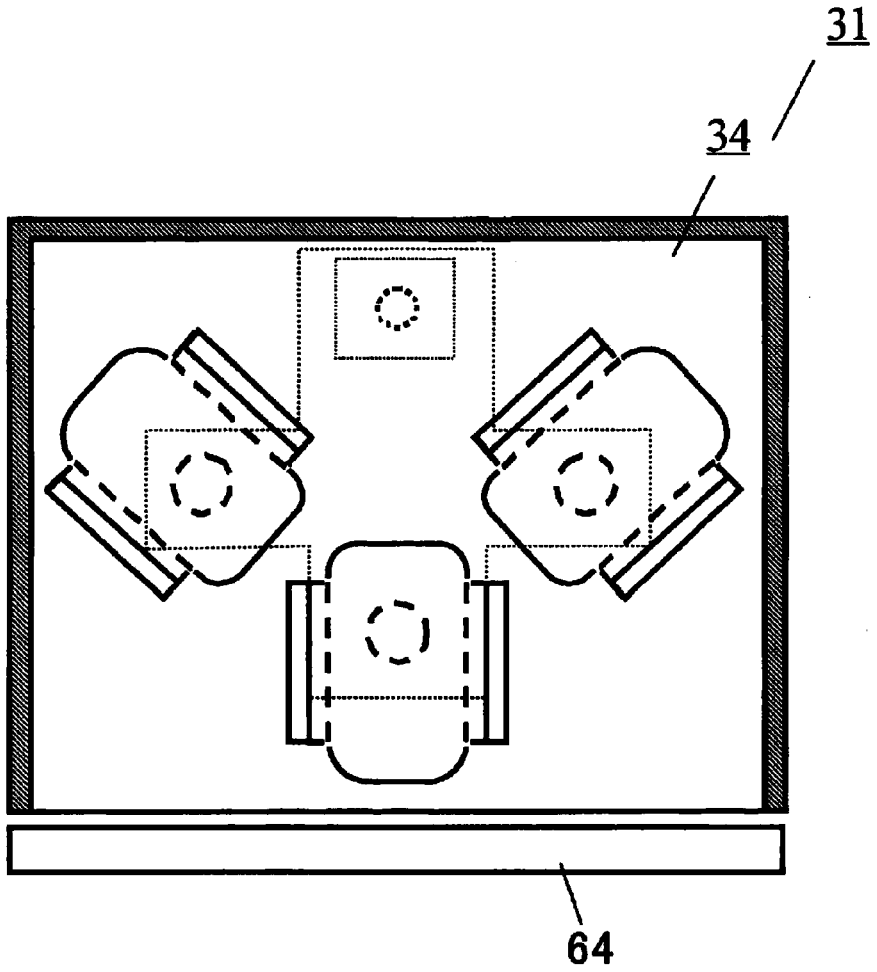
FIG. 10 is a planar sectional view of the microwave heating appliance equipped with three rotating antennas.

The case where two rotating antennas are provided is explained up to now. However, the number of rotating antennas is not limited to this, a plurality of rotating antennas in excess of two may be employed. For example, as shown in FIG. 10, the microwave heating appliance may be equipped with three rotating antennas. In a state shown in FIG. 10, end portions of respective rotating antennas are directed to the center area and its neighborhood in the heating chamber, and the food positioned around the center area can be concentratedly heated.

Figure 11:
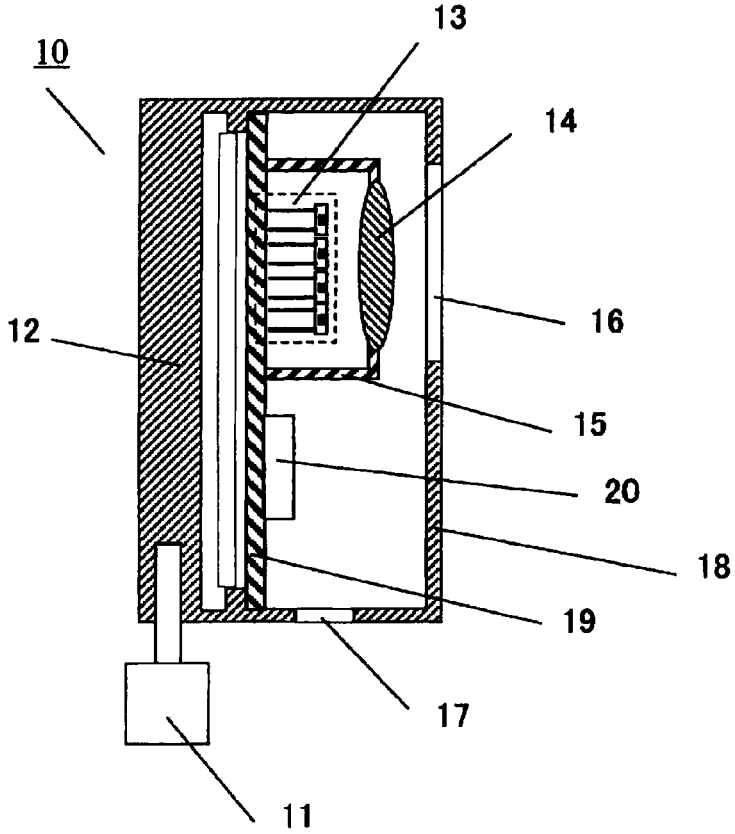
FIG. 11 is a schematic sectional configurative view of a temperature distribution detecting unit.

Next, a temperature detecting unit that the microwave oven 31 of Embodiment 1 has with reference to FIG. 11 hereunder. This temperature detecting unit has a plurality of infrared detecting elements 13 aligned on a base plate 19, a case 18 for housing the overall base plate 19, and a stepping motor 11 for moving the case 18 in the direction that intersects orthogonally with the direction along which the infrared detecting elements 13 are aligned.

A metal can 15 for sealing the infrared detecting elements 13, and an electronic circuit 20 for processing an operation of the infrared detecting element are provided to the base plate 19. Also, a lens 14 for passing through the infrared ray is provided to the metal can 15. Also, an infrared ray passing hole 16 for passing through an infrared ray and a hole 17 for passing through lead wires from the electronic circuit 20 are provided to the case 18.

According to this configuration, when the stepping motor 11 is rotated, the case 18 can be moved in the direction perpendicular to the direction along which the infrared detecting elements 13 are aligned.

Figure 12:
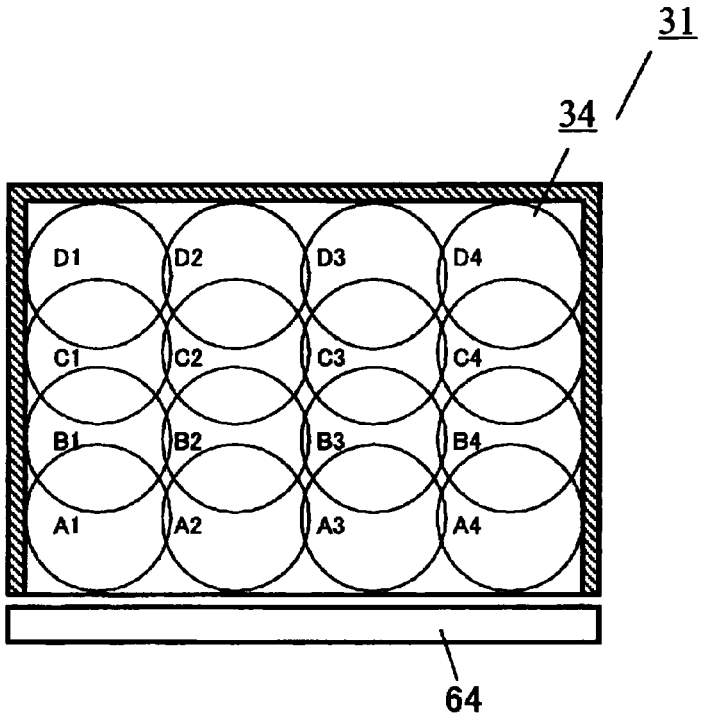
FIG. 12 is a view explaining infrared temperature detecting spots in a section along a C-C' line in FIG. 1.

FIG. 12 is a view explaining infrared temperature detecting spots in a section along a C-C' line in FIG. 1. As shown in FIG. 12, when the stepping motor 11 of the temperature detecting unit does a reciprocating motion, the microwave oven 31 of Embodiment 1 can detect the temperature distribution in substantially all areas in the heating chamber 34.

Concretely, for example, first the temperature detecting elements 13 (e.g., infrared sensors) aligned in the temperature detecting unit detect simultaneously the temperature distributions in spots A1 to A4 in FIG. 12. Then, when the stepping motor 11 is further rotated to move the case 18, the temperature detecting elements 13 detect the temperature distributions in spots B1 to B4. Then, when the stepping motor 11 is further rotated to move the case 18, the temperature detecting elements 13 detect the temperature distributions in spots C1 to C4. Similarly, the temperature distributions in spots D1 to D4 are detected.

Also, when the stepping motor 11 is rotated inversely subsequent to the above operation, the temperature distributions are detected sequentially from the spots D1 to D4 side in order of C1 to C4, B1 to B4, and A1 to A4. The temperature detecting unit can detect the overall temperature distributions in the heating chamber 34 by repeating the above operations.

Figure 13:
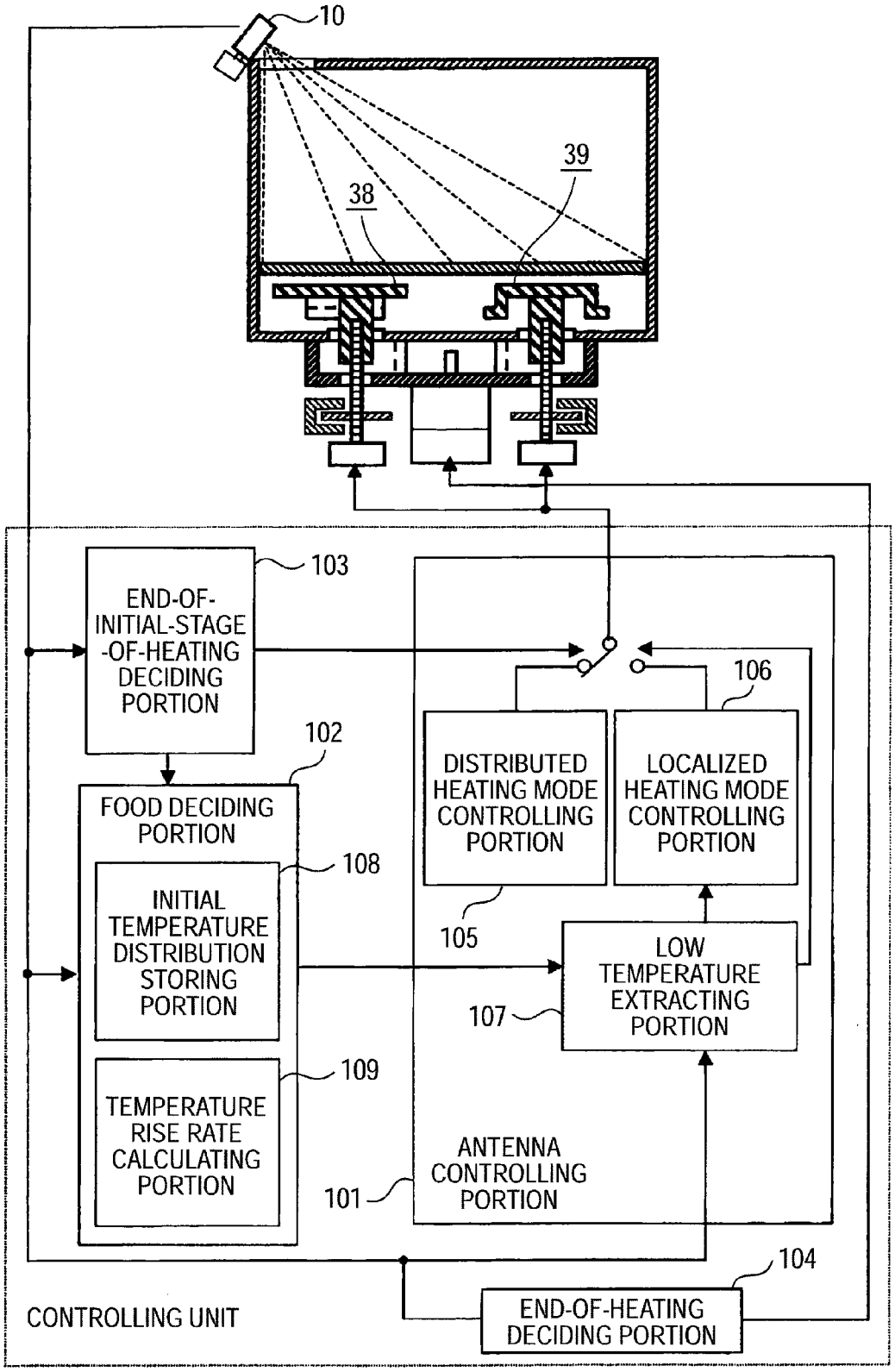
FIG. 13 is a schematic configurative view of a controlling unit 411.

Next, a schematic configuration of the controlling unit 411 will be explained with reference to FIG. 13 hereunder. The controlling unit 411 is constructed to have an antenna controlling portion 101 for controlling operations of the rotating antennas 38, 39, a food deciding portion 102 for deciding whether or not the heated subject loaded in the heating chamber 34 is the food, an end-of-initial-stage-of-heating deciding portion 103 for deciding an end of the initial stage of the heating process, and an end-of-heating deciding portion 104 for deciding an end of the overall heating process.

The food deciding portion 102 has an initial temperature distribution storing portion 108 for storing an initial temperature distribution of the heated subject, and a temperature rise rate calculating portion 109 for calculating a temperature rise rate of the heated subject per unit time. When the calculated temperature rise rate is in excess of a predetermined value, the food deciding portion 102 decides that the heated subject is the food. In other words, this food deciding portion 102 decides whether the area from which the temperature is detected corresponds either the loading table on which the heated subject is put or the food as the heated subject. This food deciding portion 102 makes a decision based on a difference in the temperature characteristic because the loading table passes through the microwave to hardly raise its temperature whereas the food tends to absorb the microwave to raise its temperature.

The end-of-initial-stage-of-heating deciding portion 103 decides whether or not the initial stage of the heating process is ended, for example, based on the criterion under which it is decided that the initial stage of the heating is ended when a predetermined time elapsed from the start of heating, the criterion under which it is decided that the initial stage of the heating is ended when a maximum temperature of the heated subject reached a predetermined temperature of more, or the criterion under which it is decided that when a maximum value of a temperature change of the heated subject since the start of heating exceeds a predetermined value.

The end-of-heating deciding portion 104 decides whether or not the heating process is ended, for example, based on the criterion under which it is decided that the heating process is ended when the maximum temperature of the heated subject in the temperature distribution exceeds a previously set temperature, the criterion under which it is decided that the heating process is ended when an average temperature at the area where the food exists exceeds a set temperature, or the criterion under which it is decided that the heating process is ended when a time required until the maximum temperature of the heated subject reaches a predetermined temperature is measured in advance, the heating process is executed for an additional heating time that constitutes a predetermined rate (e.g., 50%) of the total required time, and then the additional heating time expires.

The antenna controlling portion 101 is constructed to have a distributed heating mode controlling portion 105 for controlling the operations of the rotating antennas 38, 39 to heat uniformly the interior of the heating chamber, a localized heating (spot heating) mode controlling portion 106 for controlling the operations of the rotating antennas 38, 39 to heat a low-temperature portion of the heated subject, and a low temperature extracting portion 107 for detecting the low-temperature portion of the heated subject loaded in the heating chamber.

The distributed heating mode controlling portion 105 is constructed to implement the distributed heating, for example, by changing stop positions of the rotating antenna 38, 39 that can localizedly heat the subject by stopping in predetermined positions during the microwave oscillation, by rotating continuously the rotating antennas 38, 39, or by changing the stop positions of the rotating antennas 38, 39 at random.

The localized heating mode controlling portion 106 gets information of the lowest temperature area from the low temperature extracting portion 107, and controls the directions of the rotating antennas 38, 39 such that the food is localizedly heated. For example, when the lowest temperature area is either of spots B2, B3, C2, C3 in FIG. 12, the rotating antennas 38, 39 are directed to heat the center area, i.e., the rotating antennas 38, 39 are stopped in the stop positions shown in FIG. 4.

Also, when the lowest temperature area is either of spots B1, C1 in FIG. 12, the rotating antennas 38, 39 are directed to heat the left direction, i.e., the rotating antennas 38, 39 are stopped in the stop positions shown in FIG. 5. Also, when the lowest temperature area is either of spots B4, C4 in FIG. 12, the rotating antennas 38, 39 are directed to heat the right direction, i.e., the rotating antennas 38, 39 are stopped in the stop positions shown in FIG. 6.

Also, when the lowest temperature area is either of spots A2, A3 in FIG. 12, the rotating antennas 38, 39 are directed to heat the front area, i.e., the rotating antennas 38, 39 are stopped in the stop positions shown in FIG. 7. Also, when the lowest temperature area is either of spots D2, D3 in FIG. 12, the rotating antennas 38, 39 are directed to heat the rear area, i.e., the rotating antennas 38, 39 are stopped in the stop positions shown in FIG. 8.

As described above, the controlling unit 411 controls the stop positions of the rotating antennas 38, 39 in response to the lowest temperature area that the temperature detecting unit detected. In this case, when the radiation of the microwave into the heating chamber 34 is still continued while the rotating antennas are stopped in the predetermined position, there is a risk that a temperature of the rotating antennas themselves excessively rises and the rotating antennas are melted.

In view of this respect, the localized heating mode controlling portion 106 of the controlling unit 411 causes the rotating antennas to make a reciprocating swinging motion around a target angle (stop position) by about a predetermined angle (e.g., ±5 degree) in the above localized heating mode. As a result, a degradation of the rotating antennas can be prevented without any influence on the localized heating effect. Also, such a situation can be prevented that, because the rotating antennas continue to stop during the radiation of the microwave, the microwave concentrates excessively to a part of the rotating antennas to cause the excessive heating. This reciprocating swinging motion may be made immediately after the start of the localized heating, but also may be started after a predetermined time elapsed (e.g., after 30 second to 1 minute).

In order to execute this reciprocating swinging motion, the controlling unit 411 has a stop upper limit time storing portion for storing previously an upper limit time in which the stop of the rotating antennas 38, 39 is allowed, a stop time counting portion for counting a time in which the rotating antennas stop, and a reciprocating angle storing portion for storing an angle by which the reciprocating swinging motion of the rotating antennas 38, 39 is made.

Also, the rotating antennas may be rotated by a predetermined angle (e.g., 5 degree) after a predetermined time elapsed (e.g., after 30 seconds to 1 minute) from the start of the localized heating.

Also, the controlling unit 411 stores predetermined stop positions (angles) of the rotating antennas 38, 39 as the origins. Then, the controlling unit 411 executes an origin detecting mode that checks the origins of the rotating antennas 38, 39 either before the execution of the heating process or after the execution of the heating process, for example.

During the origin detecting mode, the angles of the rotating antennas 38, 39 cannot be specified. Thus, when the microwave is still oscillated as it is, the unintentional heating mode is caused and sometimes acts as the cause of failure. Therefore, the controlling unit 411 executes a control to stop the operation of the magnetron while the rotating antennas are driven during the origin detecting mode.

Also, the controlling unit 411 executes the origin detecting mode after the end of the heating process, and standbys in the non-heating mode in a state that the origins were detected. Thus, such a situation can be prevented that a standby time for the origin detection is generated before the heating process is started.

Also, the controlling unit 411 contains a menu indicating that, when the origin was not found in the origin detecting mode, an error is decided and the execution of the subsequent heating process is inhibited, and a menu indicating that the heating process is executed in a state that the rotating antennas 38, 39 are stopped. According to this configuration, the heating process is executed while the operation of the rotating antennas 38, 39 is still stopped according to the cooking menu, for example, when the menu in which it does not matter if deviation of the temperature distribution in the heating chamber 34 occurs (it does not matter if unevenness occurs as long as simply the heating process can be executed, or the like) is chosen, and as a result the minimum function can be provided to the user.

In this case, when the motor 40, 41 for driving the rotating antennas 38, 39 get broken, often the origins cannot be detected. Therefore, it is not safe to operate the rotating antennas 38, 39 as they are, and thus the operation of the rotating antennas 38, 39 should be stopped.

In contrast, in the case of a menu indicating that the user cannot realize the heating process to give a desired result if the temperature distribution in the heating chamber 34 is deviated, the execution itself of the heating process is inhibited.

Also, the controlling unit 411 may heat uniformly the whole heating chamber 34 in a distributed heating mode in the initial stage of the heating start, and then may shift the above heating mode to the localized heating mode after an occurrence of difference in the temperature distribution in the heating chamber 34 begins. Since no difference in the temperature distribution occurs in the heating chamber 34 in the initial stage of the heating start, a temperature of the overall heating chamber 34 can be increased effectively in the distributed heating mode.

Also, first the controlling unit 411 may heat locally the center area and the neighborhood in the heating chamber 34 in the initial stage of the heating start. Normally, when the heating process is started from a condition that there is no difference in the temperature distribution in the heating chamber, the center area and the neighborhood in the heating chamber is mostly hard to increase a temperature. Therefore, when first the center area and the neighborhood in the heating chamber 34 are locally heated and then the whole heating chamber 34 is heated uniformly by the distributed heating, the overall heating chamber can be heated uniformly effectively.

Also, the motor 40, 41 for driving the rotating antennas 38, 39 may be constructed by the stepping motor, for example. At this time, the controlling unit 411 may execute a control such that a time difference is provided to timings for inputting a pulse into respective stepping motors fitted to the rotating antennas 38, 39, every stepping motor so as not to overlap the timings with each other. When the pulses are input simultaneously, a current required at that timing is increased and thus a circuit capable of handling a large current must be provided to the microwave oven 31. In this case, a size increase of the circuit can be prevented by providing a time difference upon inputting the pulses.

Figure 14:
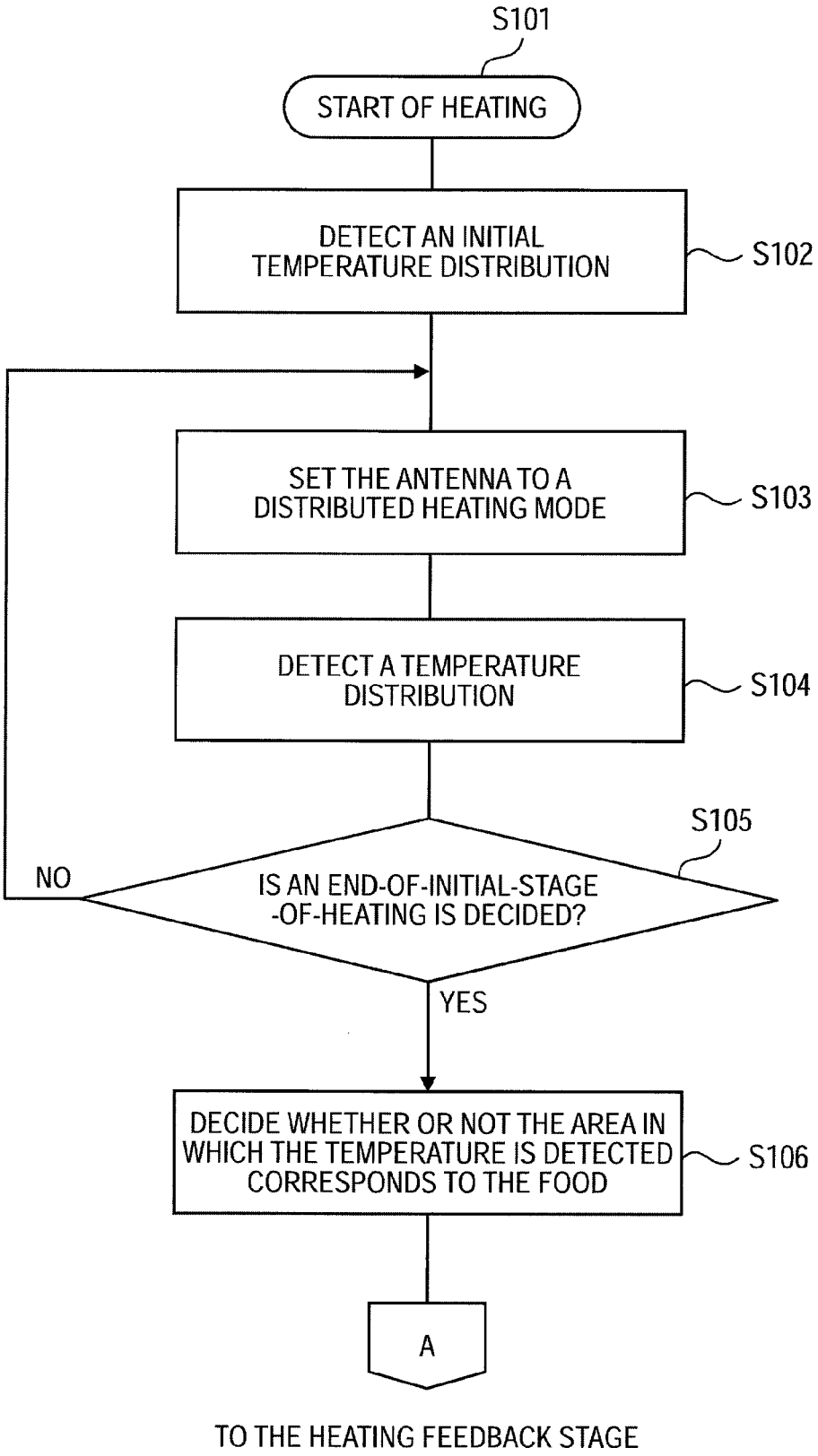
FIG. 14 is a flowchart explaining a controlling operation in the initial stage of the heating.

Next, an operation of the microwave oven 31 of Embodiment 1 will be explained hereunder. First, a controlling operation in the initial stage of the heating will be explained with reference to FIG. 14 hereunder.

At first, when the heating operation is started, the magnetron 32 generates the microwave and the microwave is transmitted to the heating chamber 34 via the waveguide (S101). At this time, the temperature detecting unit detects the temperature distribution in the heating chamber 34 at an initial point of time in the heating, and the controlling unit 411 stores the detected result of the temperature distribution (S102).

Then, the controlling unit 411 causes the rotating antennas 38, 39 to rotate at a constant speed, for example, to realize the distributed heating (S103). After a predetermined time elapsed, the temperature detecting unit detects again the temperature distribution (S104).

Then, the end-of-initial-stage-of-heating deciding portion 103 of the controlling unit 411 decides whether or not the criterion to decide that the initial stage of the heating is ended is satisfied, by referring to the temperature distribution in the heating chamber in the initial stage of the heating detected in the step S102 and the temperature distribution in the heating chamber after a predetermined time elapsed detected in the step S104. If the criterion is not satisfied (S105—No), the interior of the heating chamber 34 is heated distributedly. After a predetermined time elapsed, the temperature detecting unit detects again the temperature distribution in the heating chamber 34.

If the criterion is satisfied (S105—Yes), the controlling unit 411 decides whether or not the areas in which the temperature is detected by the temperature detecting unit correspond to the area for putting the food (S106). In this step, for example, the controlling unit 411 refers to a temperature rise rate per unit time on the area in which the temperature is detected, and then decides that the food is put on the area when the temperature rise rate is in excess of a predetermined value. Also, the controlling unit 411 may refer to the initial temperature of the area in which the temperature is detected, and then may decide that the food is put on the area when the initial temperature is minus (e.g., the frozen food, or the like is supposed). In this manner, in step S106, the controlling unit 411 discriminates the area for putting the food and other areas for not putting the food in all areas in the heating chamber 34, and stores the result therein (S106).

When the initial stage of the heating is ended, the operation of the microwave oven 31 shifts subsequently to the heating feedback stage. Then, a controlling operation in the heating feedback stage will be explained with reference to FIG. 15 hereunder. The temperature distribution detecting unit of the microwave oven 31 detects the whole temperature distribution in the heating chamber 34 after the heating initial stage is ended (S107). The temperature detecting unit extract a lowest temperature spot in the area on which the food is put in the heating chamber 34, i.e., extract the lowest temperature spot of the food area (S108).

The temperature detecting unit decides whether or not the lowest temperature spot is either of spots B2, B3, C2, C3 (S109). If the lowest temperature spot is either of spots B2, B3, C2, C3 (S109—Yes), the controlling unit 411 executes the operation control such that the rotating antennas 38, 39 are directed to heat the center area in the heating chamber 34, i.e., the rotating antennas 38, 39 are stopped in the stop positions shown in FIG. 4 (S117).

If the lowest temperature spot is none of spots B2, B3, C2, C3 (S109—No), subsequently the temperature detecting unit decides whether or not the lowest temperature spot of the food area is either of spots B1, C1 (S110).

If the lowest temperature spot is either of spots B1, C1 (S110—Yes), the controlling unit 411 executes the operation control such that the rotating antennas 38, 39 are directed to heat the left direction in the heating chamber 34, i.e., the rotating antennas 38, 39 are stopped in the stop positions shown in FIG. 5 (S118).

If the lowest temperature spot is none of spots B1, C1 (S110—No), subsequently the temperature detecting unit decides whether or not the lowest temperature spot of the food area is either of spots B4, C4 (S111).

If the lowest temperature spot is either of spots B4, C4 (S111—Yes), the controlling unit 411 executes the operation control such that the rotating antennas 38, 39 are directed to heat the right direction in the heating chamber 34, i.e., the rotating antennas 38, 39 are stopped in the stop positions shown in FIG. 6 (S119).

If the lowest temperature spot is none of spots B4, C4 (S111—No), subsequently the temperature detecting unit decides whether or not the lowest temperature spot of the food area is either of spots A2, A3 (S112).

If the lowest temperature spot is either of spots A2, A3 (S112—Yes), the controlling unit 411 executes the operation control such that the rotating antennas 38, 39 are directed to heat the front area in the heating chamber 34, i.e., the rotating antennas 38, 39 are stopped in the stop positions shown in FIG. 7 (S120).

If the lowest temperature spot is none of spots A2, A3 (S112—No), subsequently the temperature detecting unit decides whether or not the lowest temperature spot of the food area is either of spots D2, D3 (S113).

If the lowest temperature spot is either of spots D2, D3 (S113—Yes), the controlling unit 411 executes the operation control such that the rotating antennas 38, 39 are directed to heat the rear area in the heating chamber 34, i.e., the rotating antennas 38, 39 are stopped in the stop positions shown in FIG. 8 (S121).

If the lowest temperature spot is none of spots D2, D3 (S113—No), subsequently the controlling unit 411 goes to the distributed heating mode in which the antennas 38, 39 are rotated at a constant speed to heat uniformly the interior of the heating chamber 34 (S114).

Then, the controlling unit 411 makes the end decision after it executes any one of S114, S117 to S121 (S115). For example, the controlling unit 411 decides whether or not either the heating process ending criterion under which it is decided that the heating process is ended when the maximum temperature in the temperature distribution of the food exceeds a previously set temperature or the heating process ending criterion under which it is decided that the heating process is ended when an average temperature of the area that is decided as the food exceeds a set temperature is satisfied.

If it is decided that the heating process ending criterion is satisfied (S115-Yes), the heating process is ended (S116). In contrast, if it is not decided that the heating process ending criterion is satisfied (S115—No), the process goes back to step S107 and step S107 et seq. are repeated again.

As described above, the microwave oven 31 of Embodiment 1 can heat concentratedly the particular area in the heating chamber 34 by two rotating antennas, and can heat locally the lowest temperature spot of the food by detecting the temperature distribution of the food as the heated subject during the heating process. Therefore, the microwave oven 31 of Embodiment 1 can execute the heating process of the food without unevenness.

Also, the microwave oven 31 of Embodiment 1 can switch the localized heating and the distributed heating in response to the temperature distribution of the food, i.e., can concentrate the microwave to the necessary area. Therefore, the microwave oven 31 of Embodiment 1 can heat the food effectively in a short time.

Figure 15:
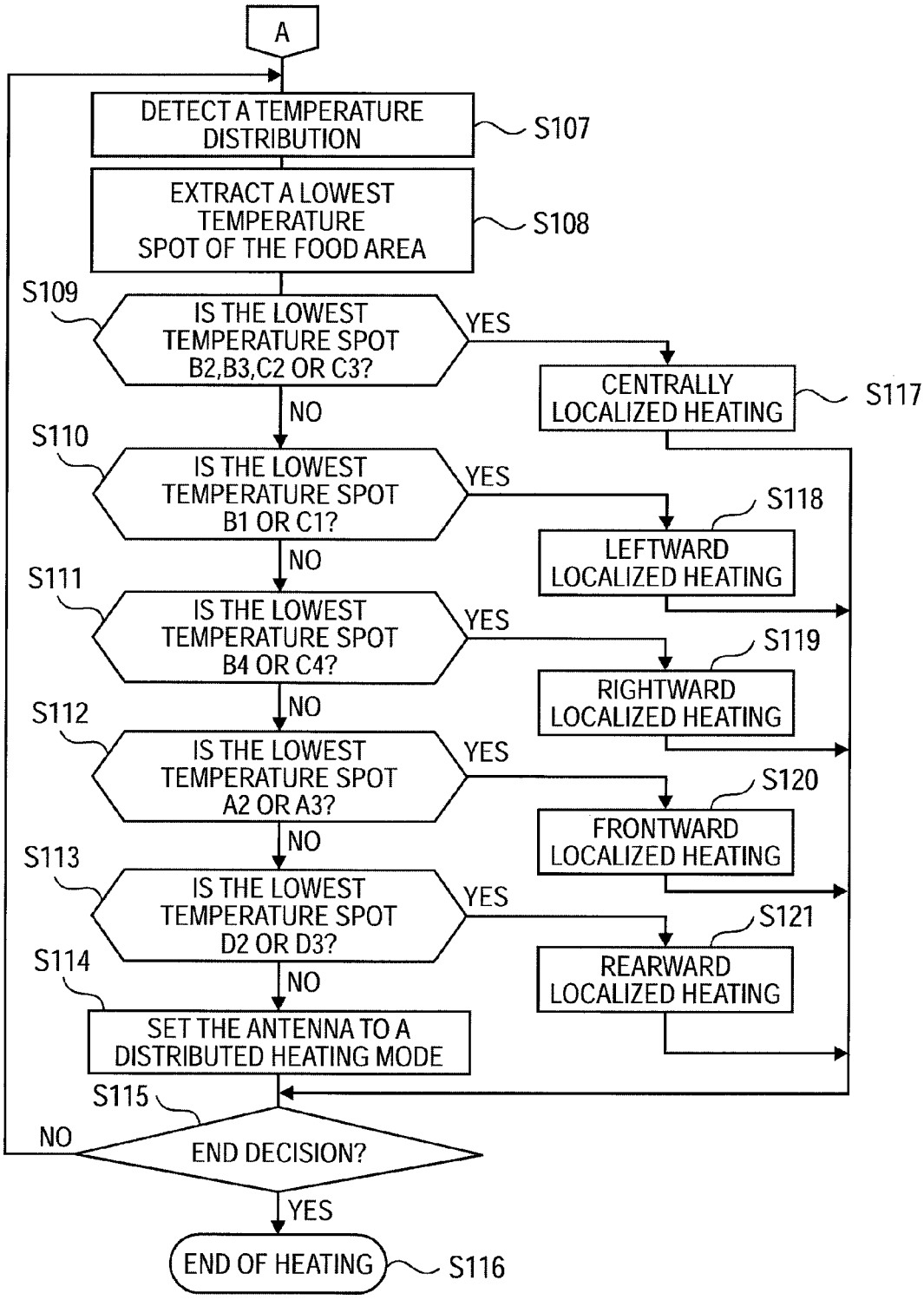
FIG. 15 is a flowchart explaining a controlling operation in the heating feedback stage.

Here, in the operation control in the heating feedback stage explained in FIG. 15, the sequence along which the lowest temperature spot of the food is searched is not limited to this illustrated example. Other sequences may be employed if the whole food area can be searched consequently.

Embodiment 2

Figure 16:
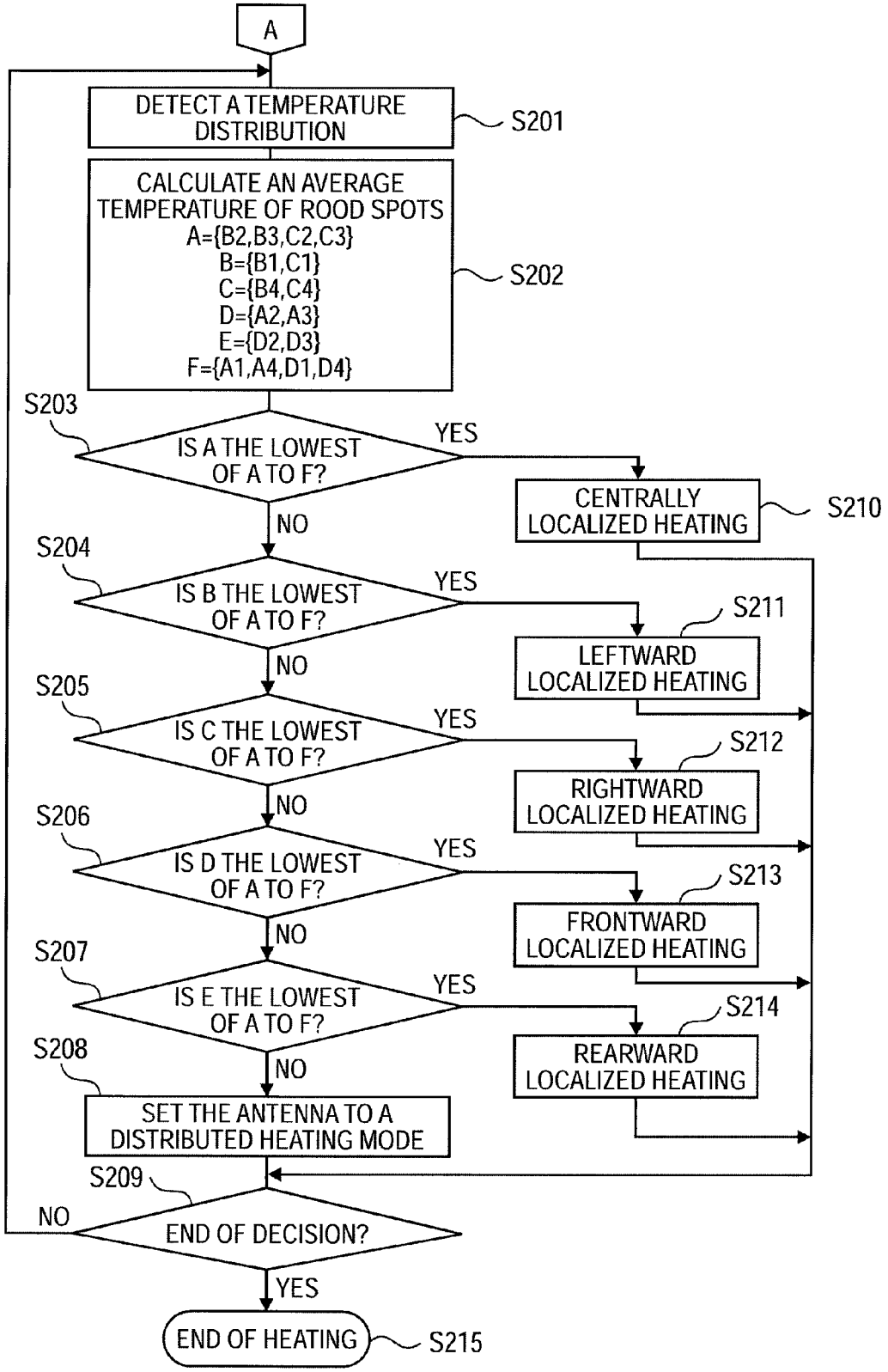
FIG. 16 is a flowchart explaining a controlling operation in the heating feedback stage of Embodiment 2 of the present invention.

FIG. 16 is a flowchart explaining a controlling operation in the heating feedback stage of the microwave oven of Embodiment 2 of the present invention. In following explanation, the same reference numerals are affixed to the same constituent elements as those explained above and their description will be omitted herein.

The microwave oven 31 of Embodiment 2 enters the heating feedback stage shown in FIG. 16 after the heating initial stage is ended. A difference between the heating feedback control of Embodiment 1 shown in FIG. 15 and the heating feedback control of Embodiment 2 shown in FIG. 16 resides in that the heating feedback control of Embodiment 2 classifies respective areas (A1 to A4, B1 to B4, C1 to C4, D1 to D4) in the heating chamber 34 into a center area A (B2, B3, C2, C3), a left area B (B1, C1), a right area C (B4, C4), a front area D (A2, A3), and a rear area E (D2, D3), and then executes the heating feedback based on the average temperature of the food area in the classified areas.

The operation control in the heating feedback stage of Embodiment 2 will be explained with reference to FIG. 16 hereunder. The temperature detecting unit of the microwave oven 31 detects the temperature distribution of the whole heating chamber 31 after the heating initial stage is ended (S201). Then, the temperature detecting unit calculates an average temperature of respective food areas of the center area A=(B2, B3, C2, C3), the left area B=(B1, C1), the right area C=(B4, C4), the front area D=(A2, A3), and the rear area E=(D2, D3) every area (S202).

In rotating, the temperature detecting unit detects the area whose average temperature is lowest among the classified areas (A-F), and the controlling unit 411 controls the operations of the rotating antennas 38, 39 in response to the result. First, the temperature detecting unit decides whether or not the lowest temperature area (the area in which the average temperature is lowest) among the classified areas (A to F) is the center area A (S203). If the lowest temperature area is the center area A (S203—Yes), the controlling unit 411 executes the operation control such that the rotating antennas 38, 39 are directed to heat the center area in the heating chamber 34, i.e., the rotating antennas 38, 39 are stopped in the stop positions shown in FIG. 4 (S210)

If the lowest temperature area is not the center area A (S203—No), subsequently the temperature detecting unit decides whether or not the lowest temperature area among the classified areas (A to F) is the left area B (S204). Then, if the lowest temperature area is the left area B (S204—Yes), the controlling unit 411 executes the operation control such that the rotating antennas 38, 39 are directed to heat the left side in the heating chamber 34, i.e., the rotating antennas 38, 39 are stopped in the stop positions shown in FIG. 5 (S211).

If the lowest temperature area is not the left area B (S204—No), subsequently the temperature detecting unit decides whether or not the lowest temperature area among the classified areas (A to F) is the right area C (S205). If the lowest temperature area is the right area C (S205—Yes), the controlling unit 411 executes the operation control such that the rotating antennas 38, 39 are directed to heat the right side in the heating chamber 34, i.e., the rotating antennas 38, 39 are stopped in the stop positions shown in FIG. 6 (S212).

If the lowest temperature area is not the right area C (S205—No), subsequently the temperature detecting unit decides whether or not the lowest temperature area among the classified areas (A to F) is the front area D (S206). If the lowest temperature area is the front area D (S206—Yes), the controlling unit 411 executes the operation control such that the rotating antennas 38, 39 are directed to heat the front side in the heating chamber 34, i.e., the rotating antennas 38, 39 are stopped in the stop positions shown in FIG. 7 (S213).

If the lowest temperature area is not the front area D (S206—No), subsequently the temperature detecting unit decides whether or not the lowest temperature area among the classified areas (A to F) is the rear area E (S207). If the lowest temperature area is the rear area E (S207—Yes), the controlling unit 411 executes the operation control such that the rotating antennas 38, 39 are directed to heat the rear side in the heating chamber 34, i.e., the rotating antennas 38, 39 are stopped in the stop positions shown in FIG. 8 (S214).

If the lowest temperature area is not the rear area E (S207—No), subsequently the controlling unit 411 goes to the distributed heating mode in which the antennas 38, 39 are rotated at a constant speed to heat uniformly the interior of the heating chamber 34 (S208).

Then, the controlling unit 411 makes the end decision after it executes any one of S208, S210 to S214 (S209). Like Embodiment 1, for example, the controlling unit 411 decides whether or not either the heating process ending criterion under which it is decided that the heating process is ended when the maximum temperature in the temperature distribution of the food exceeds a previously set temperature or the heating process ending criterion under which it is decided that the heating process is ended when an average temperature of the area that is decided as the food exceeds a set temperature is satisfied.

If it is decided that the heating process ending criterion is satisfied (S209-Yes), the heating process is ended (S116). In contrast, if it is not decided that the heating process ending criterion is satisfied (S209—No), the process goes back to step S201 and step S201 et seq. are repeated again.

In this manner, the microwave oven 31 of Embodiment 2 decides the localized heating area based on the average temperature of the food areas of the predetermined classified area (A-E). Therefore, even when the temperature is extremely low only at a part of the food, the concentrated heating can be applied the area of which the heating is required as the whole food.

Embodiment 3

As the microwave oven of Embodiment 3, a variation of the rotating antenna will be explained hereunder. In following explanation, the same reference numerals are affixed to the same constituent elements as those explained above and their description will be omitted herein. For example, as shown in FIG. 17, a circular plate-shaped antenna to a part of which an opening portion is provided may be used as the rotating antenna.

Figure 17:
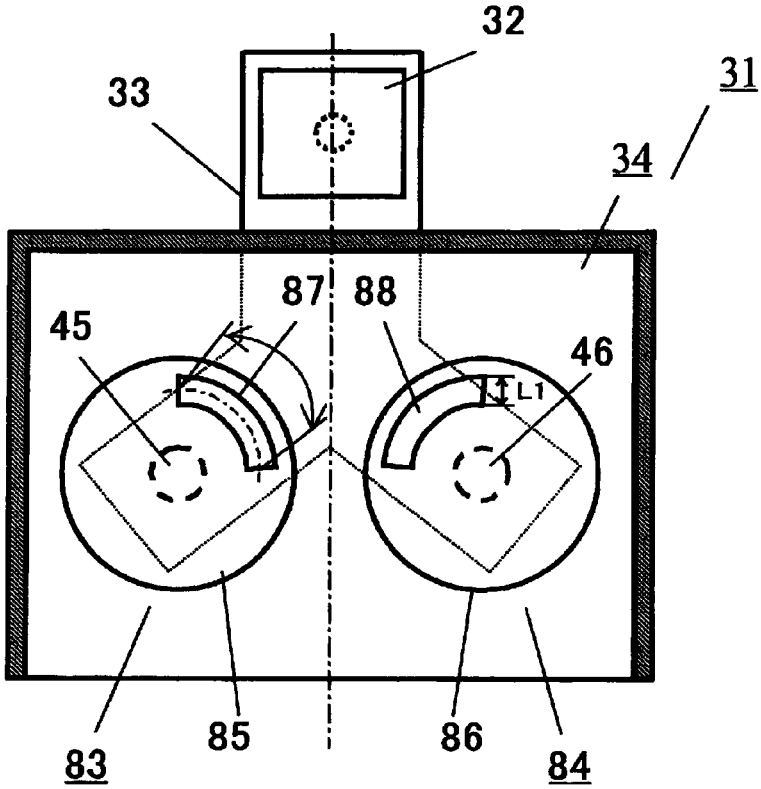
FIG. 17 is a view showing a variation of the rotating antenna.

Concretely, in FIG. 17, rotating antennas 83, 84 have circular arc-like opening portions 87, 88 on radiating portions 85, 86. A length L of the opening portions 87, 88 in the width direction is set to a ¼ wave, or more of the microwave being radiated in the heating chamber. Therefore, the rotating antennas 83, 84 have the radiation directivity at the opening portion when stopped, and thus can heat locally the particular area in the heating chamber 34.

Figure 18:
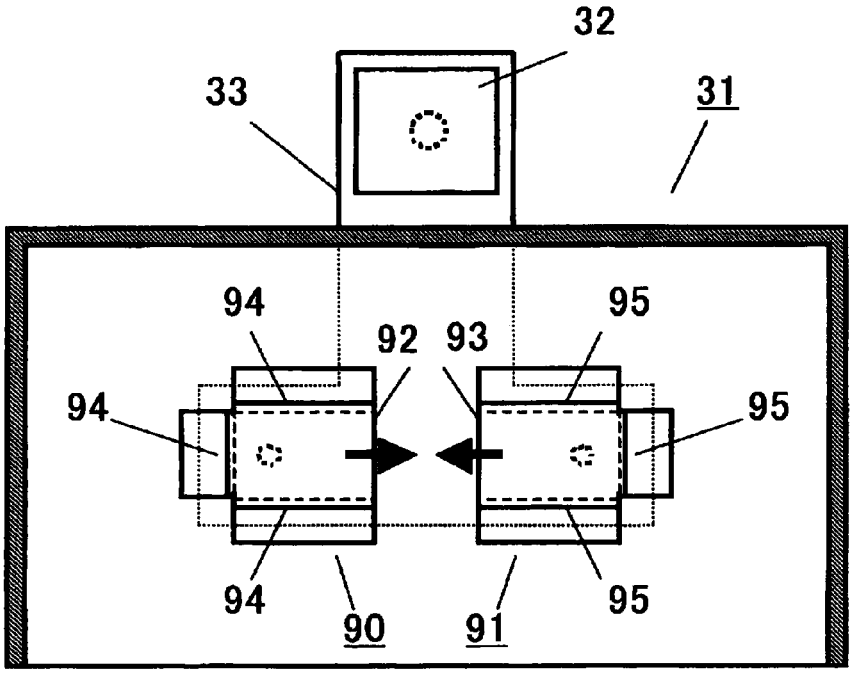
FIG. 18 is a view showing another variation of the rotating antenna.

Also, as another variation of the rotating antenna, for example, as shown in FIG. 18, there are rectangular rotating antennas 90, 91. In the rotating antennas 90, 91, three sides of the rectangular shape have bent portions 94, 95 that bent toward the bottom surface side of the heating chamber, and remaining one side portions 92, 93 are not bent. One side portions 92, 93 that are not bent have the sharp directivity, and thus the rotating antennas 90, 91 can heat locally the particular area in the heating chamber 34.

Figure 19:
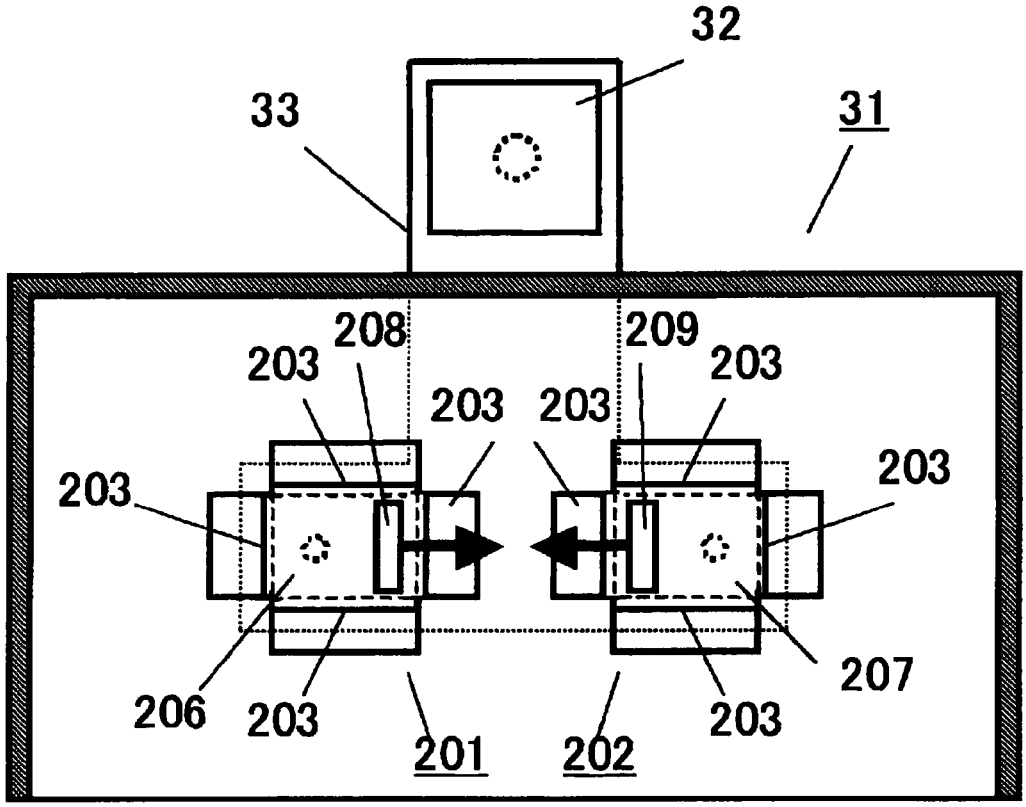
FIG. 19 is a view showing another variation of the rotating antenna.

Also, as still another variation of the rotating antenna, for example, as shown in FIG. 19, there are rectangular rotating antennas 201, 202. In the rotating antennas 201, 202, four sides of the rectangular shape have bent portions 203, 204 that bent toward the bottom surface side of the heating chamber, and opening portions 208, 209 are provided on radiating portions 206, 207. Thus, the rotating antennas 201, 202 have the sharp directivity, and can heat locally the particular area in the heating chamber 34.

Also, respective rotating antennas are spaced apart at a mutual distance of 5 mm or more. Accordingly, such a situation can be prevented that respective rotating antennas interfere with each other and thus a part of the rotating antennas is broken because of excessive heating.

In this case, the embodiments given as above can be carried out variously in combination.

The present invention is explained in detail with reference to the particular embodiments. However, it is apparent for those skilled in the art that various variations and modifications can be applied without departing a spirit and a scope of the present invention.

The present invention is explained in detail with reference to the particular embodiments. However, it is apparent for those skilled in the art that various variations and modifications can be applied without departing a spirit and a scope of the present invention.

This application is based upon Japanese Patent Application (Patent Application No. 2006-169268) filed on Jun. 19, 2006; the contents of which are incorporated herein by reference.

INDUSTRIAL APPLICABILITY

As described above, the present invention can heat concentratedly the particular heated subject by controlling the sharp part of the radiation directivity of the rotating antennas arranged in the heating chamber in the predetermined direction. Therefore, the present invention can be applied to various applications such as heating, unfreezing, ceramic art heating, drying, sintering of various dielectric materials such as the food, etc., the biochemical reaction, and the like.

The invention claimed is:

1. A microwave heating appliance, comprising:

a microwave generating unit;

a waveguide which transmits a microwave from the microwave generating unit;

a heating chamber which houses a heated subject that is heated by the microwave;

a rotating antenna which radiates the microwave from the waveguide to the heating chamber;

a driving unit which rotates and drives the rotating antenna;

a temperature distribution detecting unit which detects a temperature distribution in the heating chamber; and a controlling unit which controls a direction of the rotating antenna by controlling the driving unit based on a detected result of the temperature distribution detecting unit, wherein the controlling unit controls a sharp part of radiation directivity of the rotating antenna in a direction decided based on the detected result of the temperature distribution detecting unit to execute a concentrated heating, wherein the controlling unit includes an antenna angle storing portion which stores an angle of the rotating antenna when the sharp part of the radiation directivity of the rotating antenna is directed to a particular area in the heating chamber, and wherein the controlling unit directs the sharp part of the radiation directivity of the rotating antenna toward a low temperature portion of detected areas detected by the temperature distribution detecting unit.

2. The microwave heating appliance according to claim 1, wherein a plurality of the rotating antennas are provided in the microwave heating appliance, and wherein the controlling unit controls a sharp part of radiation directivity of at least one of the plurality of rotating antennas in the direction decided based on the detected result of the temperature distribution detecting unit to execute the concentrated heating.

3. The microwave heating appliance according to claim 2, wherein rotating centers of the plurality of rotating antennas are arranged at a substantially equal distance from a center of the interior of the heating chamber.

4. The microwave heating appliance according to claim 2, wherein a stepping motor is used as the driving unit, and a time difference is provided to timings for inputting a pulse into each stepping motor corresponding to each antenna, in every stepping motor.

5. The microwave heating appliance according to claim 1, wherein the controlling unit includes an antenna controlling portion having a localized heating mode controlling portion which controls the sharp part of the radiation directivity of the rotating antenna in the direction decided based on the detected result of the temperature distribution detecting unit to execute the concentrated heating, and a distributed heating mode controlling portion for heating uniformly an interior of the heating chamber.

6. The microwave heating appliance according to claim 5, wherein the antenna controlling portion controls the rotating antenna by the distributed heating mode controlling portion in an initial stage of heating start, and controls the rotating antenna by the localized heating mode controlling portion after the initial stage is ended.

7. The microwave heating appliance according to claim 5, wherein the antenna controlling portion controls the rotating antenna by the localized heating mode controlling portion in an initial stage of heating start, and controls the rotating antenna by the distributed heating mode controlling portion after the initial stage is ended.

8. The microwave heating appliance according to claim 5, wherein the distributed heating mode controlling portion executes the distributed heating by changing a stop position of the rotating antenna every moment, rotating continuously the rotating antenna, or changing the stop position of the rotating antenna at random.

9. The microwave heating appliance according to claim 5, wherein the localized heating mode controlling portion has a reciprocating angle storing portion for storing a reciprocating angle, and wherein the localized heating mode controlling portion makes a reciprocating swinging motion of the rotating antenna around an angle decided by referring to the antenna angle storing portion based on the detected result detected by the temperature distribution detecting unit, by the reciprocating angle stored in the reciprocating angle storing portion.

10. The microwave heating appliance according to claim 9, wherein the localized heating mode controlling portion has a stop upper limit time storing portion for storing an upper limit time in which the rotating antenna is stopped at a predetermined angle, and a stop time counting portion which counts a time in which the rotating antenna stops, and wherein when a time counted by the stop time counting portion reaches a time stored in the stop upper limit time storing portion, the rotating antenna is moved to a position that is shifted by the reciprocating angle.

11. The microwave heating appliance according to claim 1, wherein the controlling unit includes a food deciding portion which decides whether or not a heated subject loaded in the heating chamber is a food, and controls the rotating antenna based on a temperature of a food area of the food decided by the food deciding portion.

12. The microwave heating appliance according to claim 1, wherein the temperature distribution detecting unit includes a plurality of infrared detecting elements, and a driving unit which moves the plurality of infrared detecting elements in a direction that intersects with a direction along which the plurality of infrared detecting elements are aligned.

13. The microwave heating appliance according to claim 1, wherein the driving unit includes a position detecting unit which detects a position of the rotating antenna.

14. The microwave heating appliance according to claim 13, wherein the position detecting unit detects an origin of the rotating antenna in an origin detecting mode.

15. The microwave heating appliance according to claim 14, wherein the origin of the rotating antenna is checked before a heating process is executed or after a heating process is executed in the origin detecting mode.

16. The microwave heating appliance according to claim 14, wherein the controlling unit stops an operation of the microwave generating unit while the rotating antenna is driven in the origin detecting mode.

17. The microwave heating appliance according to claim 14, wherein the controlling unit contains a menu indicating that, when the origin is not found in the origin detecting mode, an error is decided and the execution of the heating process is inhibited, and a menu indicating that the heating process is executed in a state that the rotating antenna is stopped.

* * * * *